US007571985B2

(12) United States Patent
Sanada

(10) Patent No.: US 7,571,985 B2
(45) Date of Patent: Aug. 11, 2009

(54) LIQUID EJECTION HEAD AND IMAGE FORMING APPARATUS

(75) Inventor: Kazuo Sanada, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 364 days.

(21) Appl. No.: 11/237,697

(22) Filed: Sep. 29, 2005

(65) Prior Publication Data

US 2006/0066676 A1 Mar. 30, 2006

(30) Foreign Application Priority Data

Sep. 30, 2004 (JP) ..... 2004-288787

(51) Int. Cl.
*B41J 2/14* (2006.01)
*B41J 2/045* (2006.01)

(52) U.S. Cl. ..... 347/50; 347/68

(58) Field of Classification Search ..... 347/58–59, 347/68, 70–72, 94

See application file for complete search history.

(56) References Cited

U.S. PATENT DOCUMENTS

| | | | | |
|---|---|---|---|---|
| 6,491,384 | B2 * | 12/2002 | Usui et al. | 347/70 |
| 6,616,270 | B1 | 9/2003 | Miyata et al. | |
| 7,264,338 | B2 * | 9/2007 | Ogata et al. | 347/70 |
| 2003/0206218 | A1 | 11/2003 | Miyata et al. | |

FOREIGN PATENT DOCUMENTS

| | | | |
|---|---|---|---|
| JP | 9-226114 | A | 9/1997 |
| JP | 2000-127379 | A | 5/2000 |
| JP | 2001-179973 | A | 7/2001 |
| JP | 2002-234155 | A | 8/2002 |
| JP | 2003-39665 | A | 2/2003 |

OTHER PUBLICATIONS

The English translation of the Kurashima reference (JP 2001179973), pp. 1-4.*

* cited by examiner

*Primary Examiner*—Matthew Luu
*Assistant Examiner*—Lisa M Solomon
(74) *Attorney, Agent, or Firm*—Birch, Stewart, Kolasch & Birch, LLP

(57) ABSTRACT

The liquid ejection head comprises: a nozzle surface on which a plurality of nozzles are arranged; a diaphragm on which a plurality of piezoelectric elements are arranged; a plurality of pressure chambers which are defined between the nozzle surface and the diaphragm, each of the plurality of pressure chambers applying pressure to liquid which is ejected from a corresponding one of the plurality of nozzles; a common liquid chamber which is defined on a side of the diaphragm opposite to a side of the diaphragm on which the plurality of pressure chambers are defined, the common liquid chamber communicating with each of the plurality of pressure chambers via a corresponding supply port, at least a portion of a surface of the common liquid chamber which contacts liquid being made as a thin layer; and a plurality of electrical wires which are formed in a direction substantially perpendicular to a surface of the diaphragm on which the piezoelectric elements are arranged, at least a portion of each of the electrical wires passing through the common liquid chamber.

5 Claims, 20 Drawing Sheets

LIQUID EJECTION HEAD AND IMAGE FORMING APPARATUS

BACKGROUND OF THE INVENTION

1. Field of the Invention

The present invention relates to a liquid ejection head and to an image forming apparatus, more particularly to a liquid ejection head and to an image forming apparatus, with which it is possible to arrange ejection ports which eject liquid at high density.

2. Description of the Related Art

There is a known type of image forming apparatus which comprises an ink jet head (a liquid ejection head) in which a large number of nozzles (ejection ports) are arranged, and with which an image is recorded on a recording medium by ejecting ink from the nozzles towards the recording medium, while shifting this ink jet head relatively with respect to the recording medium.

This type of ink jet printer generally supplies ink from an ink tank via ink supply conduits to pressure chambers, and, by supplying electrical signals corresponding to the image data to piezoelectric elements so as to drive them, diaphragms which constitute portions of these pressure chambers are caused to be deformed, so that the volumes of these pressure chambers are reduced, thus causing the ink within these pressure chambers to be ejected from the nozzles as liquid drops.

In recent years it has become desired, even with ink jet printers, to produce images of the high picture quality commonly associated with photographic prints. In this connection, it is contemplated to implement such high picture quality, not only by reducing the size of the liquid ink drops which are ejected from the nozzles by making the diameters of the nozzles smaller, but also by increasing the number of pixels per unit area by arranging the nozzles at high density.

Along with providing ink supply conduits in the diaphragms, it is known to provide on the rear sides of the diaphragms (in other words, on the opposite sides of the diaphragms to their sides on which the plurality of pressure chambers are defined) a common liquid-chamber (a reservoir or the like) which supplies liquid to each of the plurality of pressure chambers (see, for example, Japanese Patent Application Publication Nos. 9-226114, 2000-127379 and 2001-179973).

The problem of mutual interference between the nozzles has recently become prominent, along with increase of the density of the nozzles. In other words, when ejecting ink from the nozzles by causing the pressure chambers to be deformed, combined states between the pressure chambers are sometimes set up, and this phenomenon can exert a negative influence on the ejection of ink. This problem of so-called cross-talk becomes more serious as the distance between the nozzles becomes smaller and the density at which the pressure chambers are provided becomes higher.

In order to address this type of cross-talk problem, the present inventor has previously proposed a print head which comprises a flow control device which has a certain reserve capacity with respect to the flow of liquid ink within its ink flow conduits (see Japanese Patent Application Publication No. 2003-39665 (in particular, FIG. 6)). To specify a more concrete form for this type of flow control device, by way of example, there are shown one such device in which gas-tight spaces or bag-shaped hollow spaces are provided in the interiors of the partition walls which separate between the ink conduits, and one such device in which roughening processing is performed on the end surfaces of the partition walls which separate between the ink conduits, and one in which an aperture which communicates with the external atmosphere (a dummy nozzle) is formed by drilling through a portion which constitutes a wall surface of the common ink conduit (or of an individual ink conduit), and so on.

Furthermore, a device has also been proposed in which, in a plate (a spacer plate) which is interposed between a plate in which a plurality of pressure chambers are provided and a plate in which a common liquid chamber (a manifold chamber) which supplements the ink in each of the plurality of pressure chambers is provided, there is formed a recess groove, which opens to the side of the manifold chamber, and which extends over the plurality of pressure chambers (see Japanese Patent Application Publication No. 2002-234155 (in particular, FIGS. 6 and 7)).

Yet further, a device has also been proposed in which, with an ink jet head in which the nozzles are arranged along a single line, in a side wall of an ink supply tank which supplies ink to a plurality of pressure chambers, there is provided a thinned down portion which absorbs fluctuations of the pressures in the plurality of pressure chambers (see Japanese Patent Application Publication No. 2001-179973 (in particular, FIGS. 1 and 2)).

Even if the pressure chambers are provided on the opposite sides of the diaphragms from their sides on which the common liquid chamber is defined, nevertheless, there is the problem that, along with increase of the density of the nozzle array, increase of the density of the electric wiring such as the drive wiring and so on for supplying drive signals to the piezoelectric elements becomes difficult, because the area for implementing electric wiring becomes tight; so that, finally, increase of the density of the nozzle array reaches a limit.

In concrete terms, although, in the case of an ink jet head in which the nozzles are arranged along a single line (for example, see Japanese Patent Application Publication No. 2001-179973), it is acceptable to arrange the drive wiring just one line outwards from the common liquid chamber, by contrast, in the case of an ink jet head of the full line type in which the nozzles are arranged in a two-dimensional array, i.e., in a lattice configuration or in a staggered configuration, it is necessary to arrange the large number of drive wires by leading them out from each of the large number of piezoelectric elements, which are arranged in a two-dimensional array on the lower side of the common liquid chamber, towards the exterior side of the common liquid chamber; so that, due to such problems in implementation, increase of the density of the drive wiring becomes difficult in whatever way it is approached, and moreover it also becomes difficult to increase the density of the nozzle array.

Next, the question of hampering of increase in the density of the nozzle array due to mutual interference between the nozzles (i.e., of so-called cross-talk) will be considered.

With, for example, the ink jet heads which are described in Japanese Patent Application Publication Nos. 9-226114, 2000-127379 and 2001-179973, the construction is such that it is possible to plan the nozzle length L and the supply conduit height H mutually independently, so that it is possible to avoid deterioration of the ejection response characteristic of the nozzles by making the supply conduit height H large while making the nozzle length L small, and moreover it is thereby possible to enhance the recharging characteristic of the ink into the nozzles.

Now, when the supply conduit height H is made large, on the one hand the beneficial effects are obtained that the viscous resistance proportion in the impedance of the supply conduits is reduced, and that it is possible to reduce pressure variations in the supply conduits (which entail disturbances in the ejection characteristics) due to the random consumption of ink by the various nozzles (the amount of ink consumption varies due to differences in the pattern for ejection), but there is also the problem that the inertia of the ink in the supply conduits is undesirably increased. In other words, when the burden of large flow conduits is assumed, the influence of the inertia of the liquid within these large flow conduits due to external vibration (so-called "sloshing") inevitably becomes undesirably great.

Furthermore, the countermeasure has also been considered of providing a so-called damper which is endowed with a certain liquid capacity, and of making this capacity C large. As such a damper, for example, there have been suggested: a thin portion formed in a side wall of the common liquid chamber, as described in Japanese Patent Application Publication No. 2001-179973; a flow control device, as described in Japanese Patent Application Publication No. 2003-39665; and a recess groove which is arranged so as to extend over a plurality of the pressure chambers, as described in Japanese Patent Application Publication No. 2002-234155.

The previously described countermeasure of setting the nozzle length L and the supply conduit height H independently and optimizing them, or the countermeasure of implementing a damper, are countermeasures which perform optimization of the values (R, L, C) of so-called passive elements, and, since the most suitable values for these passive elements are different according to the conditions for image formation which vary randomly, such as the picture pattern or the print ratio which is to be outputted and the like, accordingly it is necessary to bear in mind the point that, although it is possible to anticipate the beneficial effect of mitigating, to some degree, the pressures upon which each of the pressure chambers exerts its own influence, it is however not possible to anticipate so great a beneficial effect as actually resetting these pressures upon which each of the pressure chambers exerts its own influence.

SUMMARY OF THE INVENTION

The present invention has been contrived in view of the foregoing circumstances, an object thereof being to provide a liquid ejection head and an image forming apparatus, with which it is possible to increase the density of electrical wiring, such as the drive wiring which supplies drive signals to the piezoelectric elements, in a simple and easy manner, and with which, moreover, it is possible to prevent mutual interference between the nozzles, thus eliminating difficulty when increasing the density of the nozzles.

In order to attain the aforementioned object, the present invention is directed to a liquid ejection head, comprising: a nozzle surface on which a plurality of nozzles are arranged; a diaphragm on which a plurality of piezoelectric elements are arranged; a plurality of pressure chambers which are defined between the nozzle surface and the diaphragm, each of the plurality of pressure chambers applying pressure to liquid which is ejected from a corresponding one of the plurality of nozzles; a common liquid chamber which is defined on a side of the diaphragm opposite to a side of the diaphragm on which the plurality of pressure chambers are defined, the common liquid chamber communicating with each of the plurality of pressure chambers via a corresponding supply port, at least a portion of a surface of the common liquid chamber which contacts liquid being made as a thin layer; and a plurality of electrical wires which are formed in a direction substantially perpendicular to a surface of the diaphragm on which the piezoelectric elements are arranged, at least a portion of each of the electrical wires passing through the common liquid chamber.

Since, with this structure, the electrical wires are formed in an substantially vertical direction with respect to the surface on which the piezoelectric elements are arranged, and so that at least portions of them pass through the common liquid chamber, and also at least a portion of the surface of this common liquid chamber which contacts the liquid is formed as a thin layer, accordingly it is possible to increase the density of the nozzles without any requirement for arranging a large number of electrical wires on the exterior side or on the under side of the common liquid chamber, and moreover, since it is possible to prevent mutual interference between the nozzles (so-called cross-talk), accordingly it is possible to eliminate difficulties when increasing the density of the nozzles.

Preferably, the thin layer is formed substantially perpendicularly to an axis of the supply port.

With this structure, the pressures which are propagated in the reverse flow direction from the pressure chambers towards the common liquid chamber can be simply and easily reset by the thin layer which is formed substantially perpendicular to the axis of the supply port, so that it becomes possible to prevent cross-talk even more effectively.

Preferably, the liquid ejection head further comprises a gas chamber which contacts the common liquid chamber via the thin layer, and communicates with atmosphere.

With this structure, the pressures which are propagated in the reverse flow direction from the pressure chambers towards the common liquid chamber can be simply and easily reset via the thin layer by the atmospheric pressure within the gas chamber, so that it becomes possible to prevent cross-talk even more effectively.

In order to attain the aforementioned object, the present invention is also directed to a liquid ejection head, comprising: a nozzle surface on which a plurality of nozzles are arranged; a diaphragm on which a plurality of piezoelectric elements are arranged; a plurality of pressure chambers which are defined between the nozzle surface and the diaphragm, each of the plurality of pressure chambers applying pressure to liquid which is ejected from a corresponding one of the plurality of nozzles; a common liquid chamber which is defined on a side of the diaphragm opposite to a side of the diaphragm on which the plurality of pressure chambers are defined, the common liquid chamber communicating with each of the plurality of pressure chambers, the common liquid chamber having a wall in which an atmospheric communication aperture communicating with atmosphere is formed, a diameter of the atmospheric communication aperture being smaller than a diameter of the nozzle; and a plurality of electrical wires which are formed in a direction substantially perpendicular to a surface of the diaphragm on which the piezoelectric elements are arranged, at least a portion of each of the electrical wires passing through the common liquid chamber.

Since, with this structure, the electrical wires are formed in an substantially vertical direction with respect to the surface on which the piezoelectric elements are arranged, and so that at least portions of them pass through the common liquid chamber, and also, in a wall surface of this common liquid chamber, there is formed the atmospheric communication aperture which communicates with the atmosphere, of which diameter is smaller than the diameter of the nozzle, accordingly, along with it being possible to increase the density of the nozzles without any requirement to arrange a large number of electrical wires on the exterior side or on the under side of the common liquid chamber, moreover, since it is possible to prevent mutual interference between the nozzles (so-called cross-talk), accordingly it is possible to eliminate difficulties when increasing the density of the nozzles. Furthermore, it is possible to regulate the pressure within the common liquid chamber with a simple structure.

In order to attain the aforementioned object, the present invention is also directed to an image forming apparatus, comprising the above-described liquid ejection head.

With this structure, it is possible to form an image at high density with nozzles of which the density has been increased.

According to the present invention, along with it being possible to increase the density of the electrical wiring, such as the drive wiring for supplying drive signals to the photoelectric elements and so on, in a simple and easy manner, it is also possible to prevent mutual interference between the nozzles, so that it is possible to eliminate difficulties when increasing the density of the nozzles.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
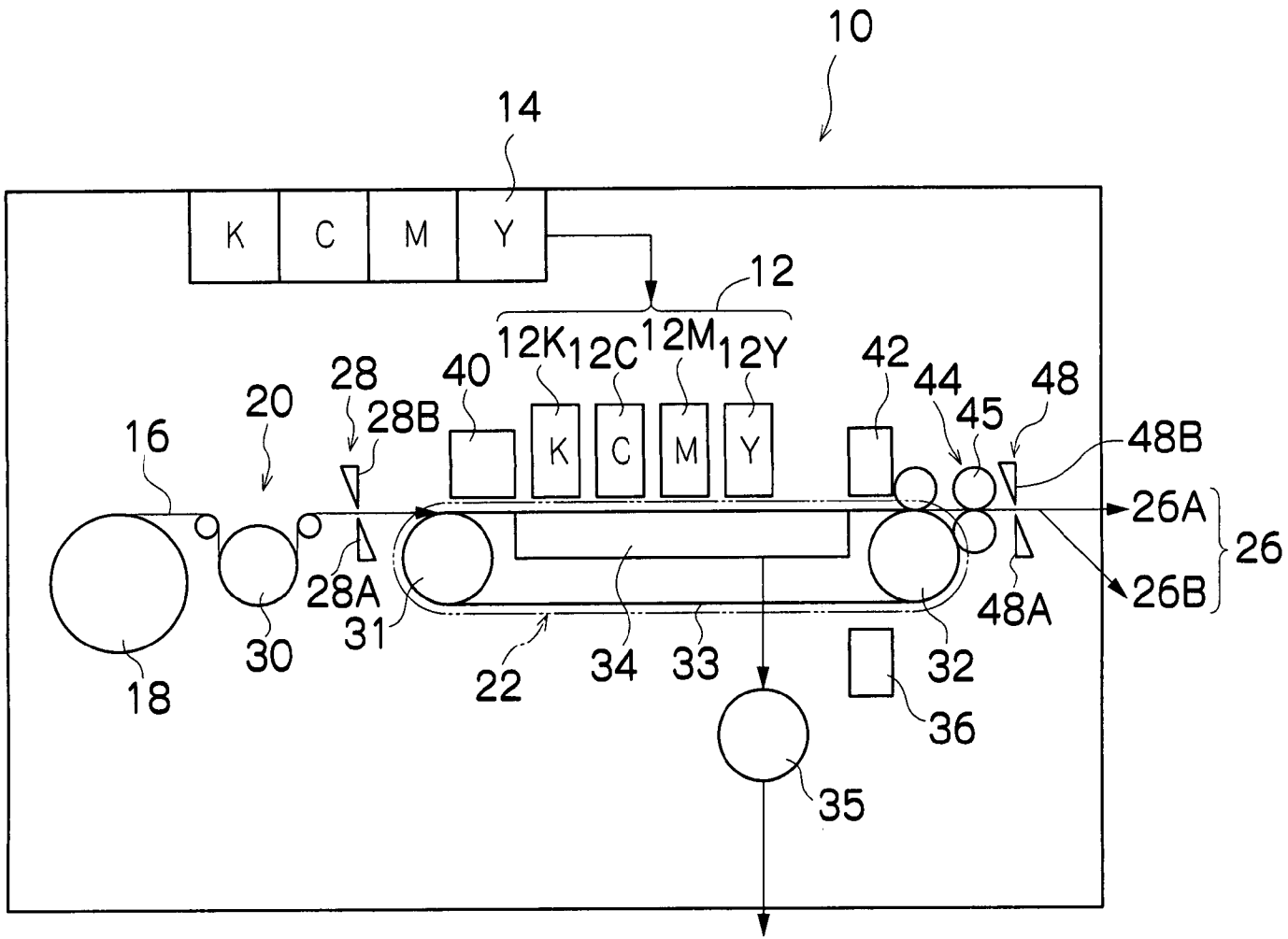
FIG. 1 is a general schematic drawing showing the overall structure of an example of an inkjet recording apparatus, which is an image forming apparatus including a liquid ejection head according to the present invention.

FIG. 1 is a general schematic drawing showing the overall structure of an example of an inkjet recording apparatus, which is an image forming apparatus including a liquid ejection head according to the present invention.

As shown in FIG. 1, this inkjet recording apparatus 10 comprises: a print unit 12 which comprises a plurality of print heads (liquid ejection heads) 12K, 12C, 12M, and 12Y provided for the respective ink colors; an ink storing and loading unit 14 which stores ink to be supplied to the print heads 12K, 12C, 12M, and 12Y; a paper supply unit 18 which supplies recording paper 16; a decurling unit 20 which eliminates curl from the recording paper 16; a suction belt conveyance unit 22 which is arranged to confront a nozzle surface (an ink ejection surface) of the print unit 12, and which conveys the recording paper 16 while maintaining its planar state; and a paper output unit 26 which ejects the recording paper (now printed matter) to the exterior when printing thereon has been completed.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a device structure which employs rolled paper, as in FIG. 1, a cutter 28 for guillotining is provided, and the rolled paper is cut to the desired size by this cutter 28. The cutter 28 comprises a stationary blade 28A which has a length greater than the width of the paper transport path, and a cutting blade 28B which shifts along that stationary blade 28A; and the stationary blade 28A is provided at the rear side of the paper, opposite to its side on which printing is performed, while the cutting blade 28B is located on the other side of the paper transport path, at the side of the paper on which printing is performed. It should be understood that, if cut paper is used, the cutter 28 may be omitted.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 forms a plane (flat plane).

The belt 33 has a width dimension which is greater than the width of the recording paper 16, and, in the surface of this belt 33, there are formed a large number of suction holes (not shown in the drawing). As shown in FIG. 1, a suction chamber 34 is provided on the inside of the belt 33, so as to extend between rollers 31 and 32, in a position to oppose the nozzle surface of the print unit 12; and, by the air in this suction chamber 34 being sucked out by a fan 35 so as to generate a negative pressure, the recording paper 16 is sucked down against the belt 33 and held in position there. By the drive force of a motor (not shown in the drawing) being transmitted to at least one of the rollers 31 and 32 so as to wind the belt 33, this belt 33 is driven in the clockwise direction as seen in FIG. 1, so that the recording paper 16, which is held on the belt 33, is conveyed from left to right as seen in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
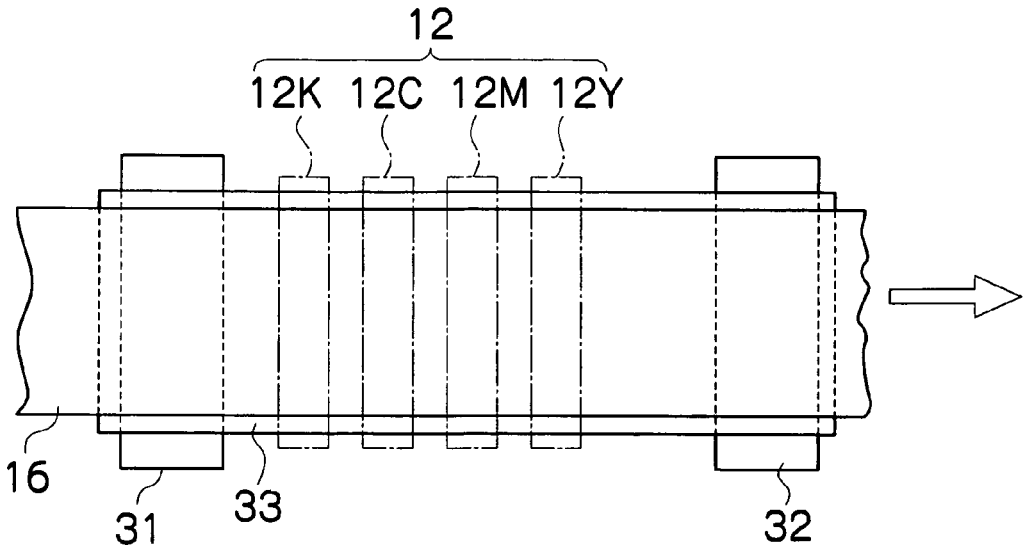
FIG. 2 is a principal plan view showing the surroundings of a print unit of the inkjet recording apparatus shown in FIG. 1.

In the print unit 12, a linear type head, which has a length which corresponds to the maximum paper width, is arranged in the direction (the sub-scanning direction) which is orthogonal to the paper transport direction (the main scanning direction), and comprises a so-called full line type print head (see FIG. 2).

As shown in FIG. 2, each of the print heads 12K, 12C, 12M, and 12Y comprises a plurality of ink ejection ports (nozzles) which are arrayed over a length which is greater than at least one side of the maximum size recording paper 16 which is to be used in this inkjet recording apparatus 10.

The print heads 12K, 12C, 12M, and 12Y for the inks of the various colors are disposed in the order black (K), cyan (C), magenta (M), and yellow (Y) along the transport direction of the recording paper 16 (the paper transport direction) from its upstream side (the left side in FIG. 1). A color image is formed on the recording paper 16 by ejecting ink of the respective colors from these print heads 12K, 12C, 12M, and 12Y while transporting the recording paper 16.

In this manner, with this print unit 12 in which a full line head which extends across and covers the entire width of the paper is provided for the ink colors, it is possible to record an image over the entire surface of the recording paper 16 by only performing a single operation of shifting the recording paper 16 and the print unit 12 relative to one another in the paper transport direction (the sub-scanning direction) (in other words, with a single sub-scan). Due to this, it is possible to perform printing at high speed, as compared to the case of using a shuttle type head, with which the print head operates to-and-fro in the direction orthogonal to the paper transport direction (i.e., in the main scanning direction), and thus it is possible to enhance the productivity.

Furthermore although, in this embodiment, by way of example, a structure has been shown in which the standard four ink colors KCMY are used, this particular embodiment is not limitative of the number of inks and the combinations of colors which may be employed; according to requirements, it would also be acceptable additionally to use a light ink or a dark ink. For example, a construction may be used including an additional print head which ejects a light type ink, such as light cyan or light magenta or the like.

As shown in FIG. 1, the ink storing and loading unit 14 comprises ink tanks which store inks of colors corresponding to the print heads 12K, 12C, 12M, and 12Y, and each of these tanks communicates with its corresponding one of the print heads 12K, 12C, 12M, and 12Y via a conduit not shown in the drawing. Furthermore, this ink storing and loading unit 14 comprises a notification device (a display device, a device for generating an audible warning, or the like) which, when the amount of ink remaining in some tank becomes low, emits a warning to that effect; and it also comprises a mechanism for preventing erroneous loading of ink of the incorrect color into the wrong ink tank.

A post-drying unit 42 is disposed following the print heads 12K, 12C, 12M, and 12Y. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Moreover, although this is not shown in the drawing, a sorter which accumulates the printed images in order is provided to the paper output unit 26A for the target images.

Next, the arrangement of the nozzles (the liquid ejection ports) of the print heads (the liquid ejection heads) will be explained. Since the structure for each of the print heads 12K, 12C, 12M, and 12Y which are provided for each of the colors is the same, a representative one of these print heads denoted by the reference numeral 50 will be described in the following explanation; a perspective plan view of this print head 50 is shown in FIG. 3.

Figure 3:
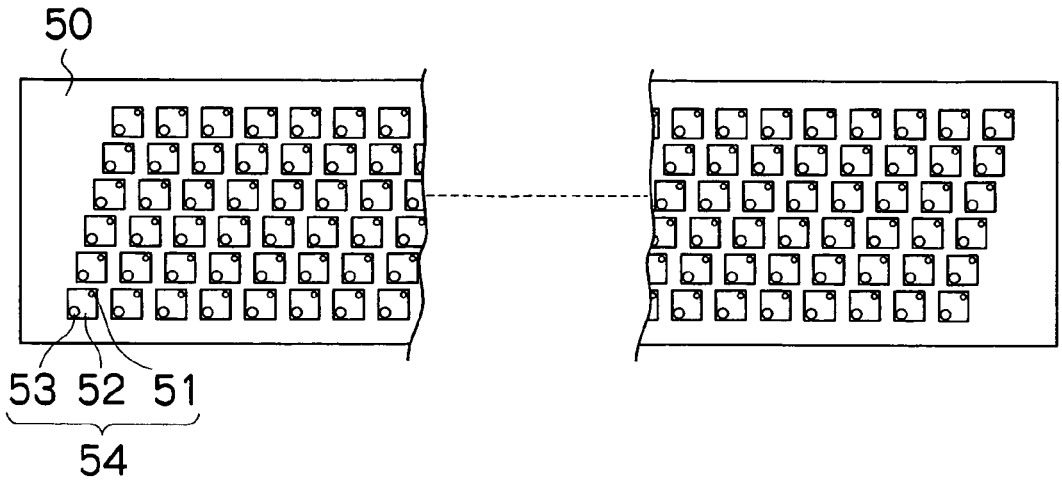
FIG. 3 is a perspective plan view showing an example of a print head structure.

Referring to FIG. 3, in this print head 50, a plurality of pressure chamber units 54 are arranged in a two-dimensional matrix. Each of these pressure chamber units 54 comprises a nozzle 51 which ejects ink as liquid drops, a pressure chamber 52 which applies pressure to ink when ejecting it, and an ink supply port 53 which supplies ink to the pressure chamber 52 from a common liquid chamber not shown in FIG. 3.

In the embodiment shown in FIG. 3, the shape in plan view of each of the pressure chambers 52 is generally square, as seen from above. In each of the pressure chamber units 54, its nozzle 51 is formed at one end of one of its diagonals, while its ink supply port 53 is provided at the other end of that diagonal. It should be understood that although, as shown in FIG. 3, in this embodiment, the case is explained in which the shape of each of the pressure chambers 52 as seen from above in plan view is substantially a square, this is not limitative of the present invention; i.e., in the present invention, the shape in plan view of the pressure chambers 52 is not limited to being such a square shape.

Figure 4:
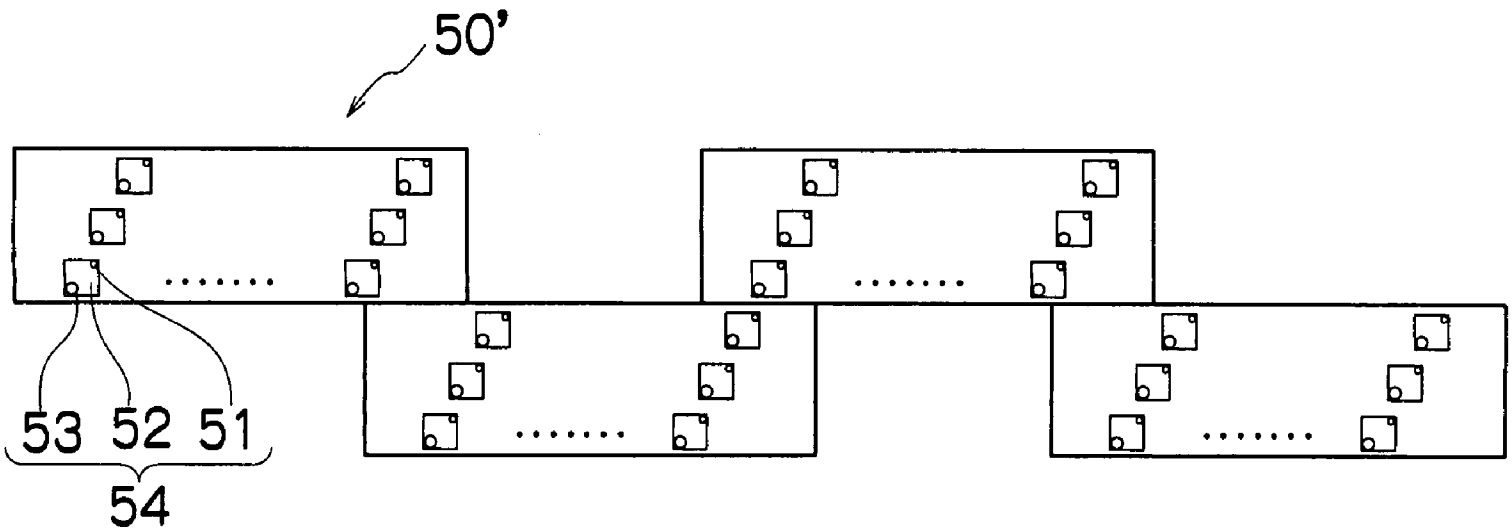
FIG. 4 is a perspective plan view showing another example of a print head structure.

Furthermore, FIG. 4 is a perspective plan view showing an example of an alternative structure for another print head. As shown in FIG. 4, a single long full line head may be made up by arranging a plurality of short heads 50' so that they are connected together in a two-dimensional staggered manner, thus spanning a length which corresponds to the entire width of the printing medium with the combination of all these short heads 50'.

Figure 5:
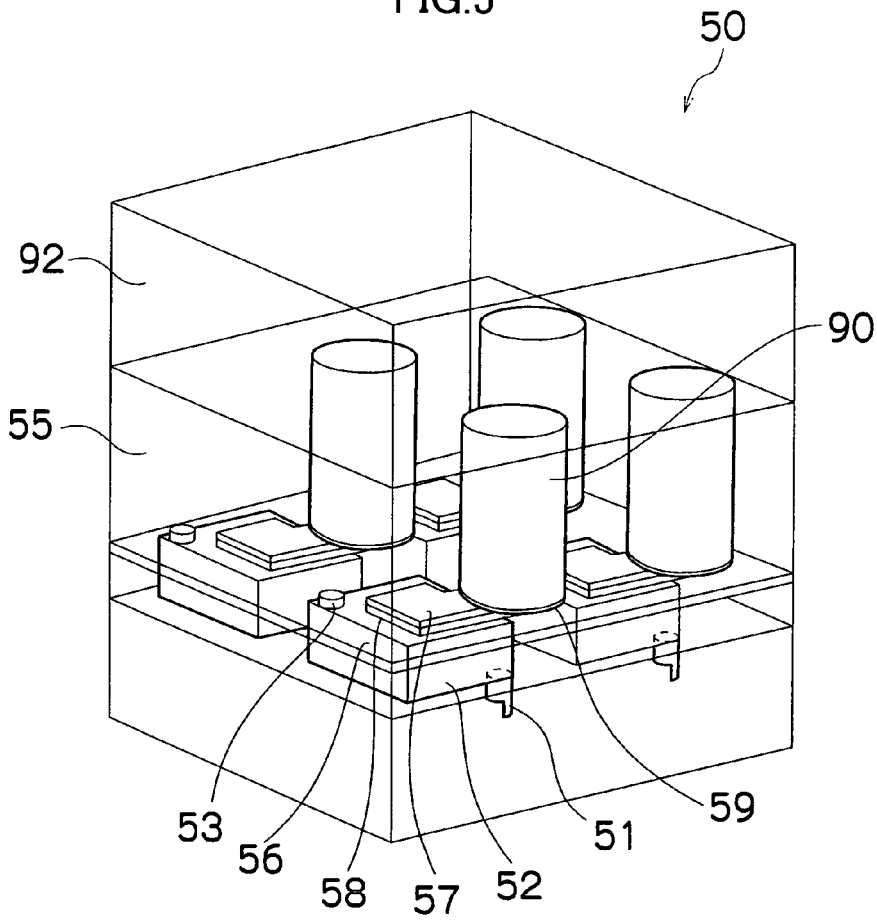
FIG. 5 is a simplified perspective view showing a portion of a print head.

In order to explain the fundamental structure of each of these print heads 50, a portion of one of them is shown in oblique perspective view in FIG. 5 in a simplified manner.

In the print head 50 shown in FIG. 5 in a simplified manner, above the pressure chamber 52 which applies pressure to the ink when ejecting it there is disposed a diaphragm 56, and, above this diaphragm 56, there is disposed a piezoelectric element 58 which acts as a pressure generation device, and which comprises a piezoelectric body such as a piezo element. Thus, the diaphragm 56 transmits the pressure generated by the piezoelectric element 58 to the pressure chamber 52. Furthermore, the piezoelectric element 58 is sandwiched between two electrodes: one on its lower side (a common electrode) which is constituted by the diaphragm 56, and another individual electrode 57, disposed directly on top of this piezoelectric element 58, which corresponds to the diaphragm 56.

An electrode pad 59 is formed as an extension from the edge of the individual electrode 57 to the exterior, and functions as an electrode connection section; and, above this electrode pad 59, there is provided an electrical wire 90 formed in the shape of a pillar, which extends substantially in the perpendicular direction with respect to the surface of the diaphragm 56 on which the piezoelectric element 58 is provided (in the case of the print head 50 shown in FIG. 5, its upper surface). Due to its shape, this upwardly erected pillar shaped electrical wire 90 may be termed an electric column. A multi-layer flexible cable 92 is disposed above the electrical wire 90, and a drive signal is supplied from the flexible cable 92, via this electrical wire 90 and the individual electrode 57, to the piezoelectric element 58.

Furthermore, the space defined between the diaphragms 56 and the flexible cable 92, and through which the electrical wires 90 are erected, constitutes a common liquid chamber 55 for supplying ink to the pressure chambers 52, via their corresponding ink supply ports 53. These electrical wires 90 support the flexible cable 92 from below, thus defining the space which constitutes the common liquid chamber 55. To put it in another manner, the electrical wires (electric columns) 90 are formed so as to rise up and pass through the common liquid chamber 55

It should be understood that, although the pillar shaped electrical wires 90 shown here are made so as to support the multi-layer flexible cable 92 from below, it would also be acceptable, instead of employing such a multi-layer flexible cable 92, to connect an IC (Integrated Circuit) chip which drives the piezoelectric element 58 directly to the pillar shaped electrical wires 90. Moreover, although this detail is not shown in FIG. 5, an insulating protective layer (a ceiling plate) is provided so as to constitute a ceiling of the common liquid chamber 55.

Furthermore although, in the structure shown in FIG. 5, one of the electrical wires 90 is provided for each one of the piezoelectric elements 58, and they correspond one-to-one, it would also be acceptable, in order to reduce the number of wires (the number of electric columns), for a single electrical wire 90 to be provided corresponding to a plurality of the piezoelectric elements 58, so that some plural number of the piezoelectric elements 58 corresponded, as a group, to each one of the electrical wires 90. Yet further, apart from the individual electrodes 57, it would also be acceptable for the wiring corresponding to the common electrode (the diaphragm 56) also to be provided as one of the pillar shaped electrical wires 90. Wiring which transmits a sensor signal outputted from a pressure sensor (not shown in the drawings) for detecting non-ejection of ink may also be made as a pillar shaped electrical wire.

Furthermore, although the common liquid chamber 55 shown in FIG. 5 is built as a single large space and spans the entire region where the pressure chambers 52 are formed, so as to supply ink to all of the pressure chambers 52 shown in FIG. 3, this common liquid chamber 55 is not limited to being made in this way as a single space; it would also be acceptable for it to be divided up into a number of regions, with a plurality of such liquid chambers thus being formed.

As shown in FIG. 5, the nozzle 51 is formed in the bottom surface of the pressure chamber 52, and the ink supply port 53 which communicates with the common liquid chamber 55 is provided at a portion of the upper surface of the pressure chamber 52 which is diagonally opposite to the nozzle 51 in its bottom surface. This ink supply port 53 is pierced through the diaphragm 56, and the common liquid chamber 55 and the pressure chamber 52 are directly communicated together via this ink supply port 53. In this manner, it is possible to connect the common liquid chamber 55 and the pressure chambers 52 together directly.

The diaphragm 56 is formed as a single plate which serves for all of the pressure chambers 52 in common. And the piezoelectric elements 58 for deforming the pressure chambers 52 are disposed at portions of this common diaphragm 56 corresponding to the pressure chambers 52. The electrodes (the common electrode and the individual electrodes) for applying voltage to the piezoelectric elements 58 and driving them are formed on the upper and lower surfaces of the photoelectric element 58, so as to sandwich it between them.

Furthermore, although this detail is not shown in FIG. 5, in order to fill the common liquid chamber 55 with ink, each of the surfaces of the diaphragm 56 which acts as the common electrode, of the individual electrodes 57, of the electrical wires 90, and of the flexible cable 92 which comes into contact with the ink is covered with an insulating protective layer.

Yet further, although this is not shown in FIG. 5, an insulating layer is provided between the diaphragm 56 and the electrode pad 59.

It should be understood that, although the various dimensions of the components of the print head 50 described above are not particularly limited, as a representative example thereof, the pressure chambers 52 may be made, in plan view, roughly in the shape of squares 300 μm×300 μm (the corners are chamfered so as to eliminate any points at which the flow of ink may stagnate), with heights of 150 μm, and the diaphragms 56 and the piezoelectric elements 58 may each have thickness of 10 μm, while the diameter of the sections of the electrical wires 90 (the electric columns) which connect to the electrode pads 59 may be 100 μm, and their height may be 500 μm, or the like.

Moreover, in practice, on the exteriors of these electrical wires 90 (electric columns) which are electrically conductive, they are provided with insulating material for insulating them from the ink.

Figure 6:
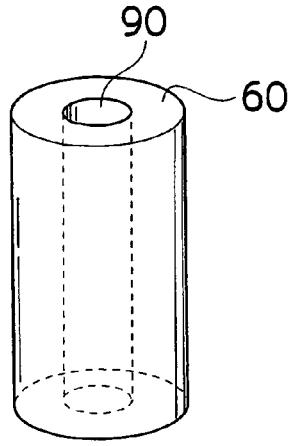
FIG. 6 is an oblique perspective view showing an example of an electric wiring structure.

FIG. 6 is a perspective view showing an example of one of the electrical wires 90. It should be understood that this electrical wire 90 shown in FIG. 6 is an electrically conductive body.

Referring to FIG. 6, an insulating body 60 (also called a peripheral portion), of which external diameter is larger than that of the electrically conductive body 90 (which is formed as a circular cylinder), and which is coaxial with the electrically conductive body 90, is provided on the outer periphery of this electrically conductive body 90. The electrical wires 90, which are thus insulated from liquid by this type of insulating body 60, are disposed so as to pass through the common liquid chamber 55.

Figure 7:
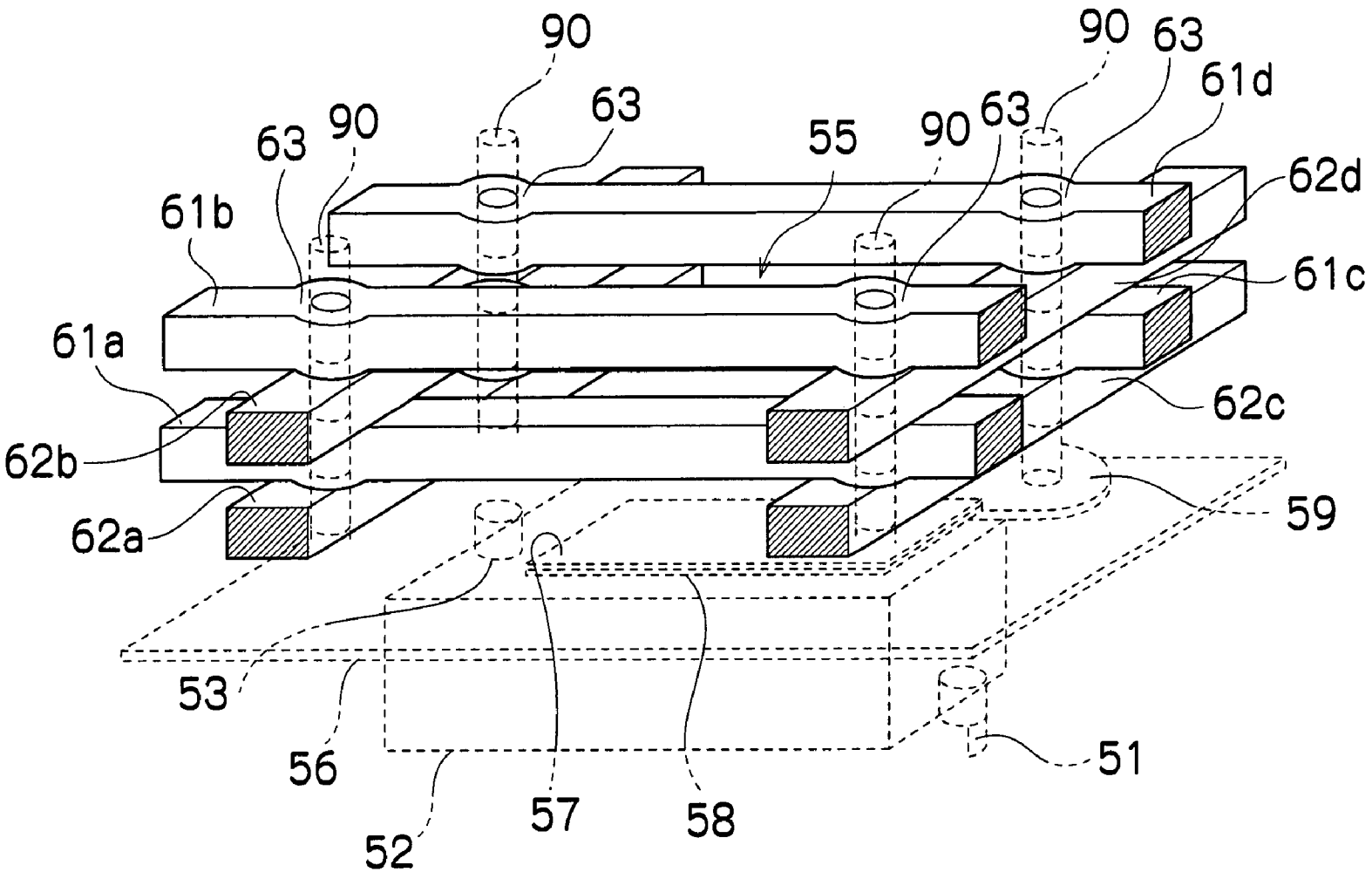
FIG. 7 is an oblique perspective view showing another example of an electric wiring structure.

FIG. 7 is a perspective view showing another example of one of the electrical wires 90. It should be understood that in this FIG. 7, just as in FIG. 6, the electrical wires 90 shown in the drawing are electrically conductive bodies.

This FIG. 7 example differs from the case shown in FIG. 6, in that first wiring plates 61 (61*a*, 61*b*, 61*c*, 61*d*) and second wiring plates 62 (62*a*, 62*b*, 62*c*, 62*d*), which are made from an insulating material and have the shape of bands, are stacked up in alternate layers crossing one another at different levels; and, at the portions 63 at which these first wiring plates 61 and second wiring plates 62 cross one another at different levels, there are provided the electrical wires 90 which are made from an electrically conductive material.

It should be understood that, in FIG. 7, corresponding to a single one of the piezoelectric elements 58 (or to a single one of the pressure chambers 52), the portions of four first wiring plates 61 (61*a*, 61*b*, 61*c*, 61*d*) and four second wiring plates 62 (62*a*, 62*b*, 62*c*, 62*d*) which are alternatively stacked over one another within the common liquid chamber 55 are shown, and the wiring plates 61 and 62 which correspond to a single one of the piezoelectric elements 58 (or to a single one of the pressure chambers 52) are stacked so as to constitute a criss-cross frame.

Within the common liquid chamber 55, in the direction which is perpendicular to that surface of the diaphragm 56 on which the piezoelectric elements 58 are disposed (in FIG. 7, its upper surface), there are defined gaps between the first wiring plates 61 themselves (in FIG. 7, a gap between the wiring plate to which the reference symbol 61*a* is appended and the wiring plate to which the reference symbol 61*b* is appended, and a gap between the wiring plate to which the reference symbol 61*c* is appended and the wiring plate to which the reference symbol 61*d* is appended), gaps between the second wiring plates 62 themselves (in FIG. 7, a gap between the wiring plate to which the reference symbol 62*a* is appended and the wiring plate to which the reference symbol 62*b* is appended, and a gap between the wiring plate to which the reference symbol 62*c* is appended and the wiring plate to which the reference symbol 62*d* is appended), and gaps between the wiring plates 61 and 62 and the bottom surface and the ceiling of the common liquid chamber 55. In other words, a plurality of flow conduits are defined within the common liquid chamber 55, the cross sectional shapes of whose openings are rectangular. It should be understood that, if the common liquid chamber 55 itself is viewed as a single flow conduit (a common flow conduit), then the above described plurality of flow conduits which are formed by the superimposed layer structure of the wiring plates 61 and 62 may be considered to constitute a portion of this common flow conduit.

Due to this criss-cross type superimposed layer construction on different levels (overall, the print head 50 is endowed with a superimposed layer construction in the form of a multi-level grating), not only is the print head 50 made rigid, but also the ink is enabled to flow within the common liquid chamber 55.

It should be understood that, although the way in which the electrical wires 90 are arranged within the common liquid chamber 55 is not limited to the cases shown in FIG. 6 or FIG. 7, it is possible to increase the density of the nozzles 51 by forming the electrical wires 90 almost perpendicularly with respect to the surface on which the piezoelectric elements 58 are disposed, so that they stand erect within the common liquid chamber 55 and pass through the common liquid chamber 55. For example, it would also be acceptable to make the electrical wires 90 to be, not cylindrical pillars of uniform cross sectional area as shown in FIG. 6, but so that their cross sectional area increases gradually from below to upwards, i.e., in a so called tapered form.

In the following, by way of example, a case will be explained in which, as shown in FIG. 6, around the peripheries of the electrically conductive members (electrical wires) 90, there are provided insulating bodies 60 (peripheral portions) which are coaxial with the electrically conductive members 90. This case is chosen in order to simplify the explanation; it goes without saying that it would also be acceptable to impart rigidity to the print head 50 by utilizing a structure like the one shown in FIG. 7.

In the case of a print head comprising, as explained above using FIGS. 5 through 7, a plurality of electrical wires 90 which are arranged so as to stand erect substantially vertically within a common liquid chamber 55 and so as to pass through the common liquid chamber 55 in the substantially vertical direction, various measures for preventing mutual interference between the nozzles 51 (so called cross-talk) will now be explained in detail for first through fifth embodiments of the present invention.

Figure 8:
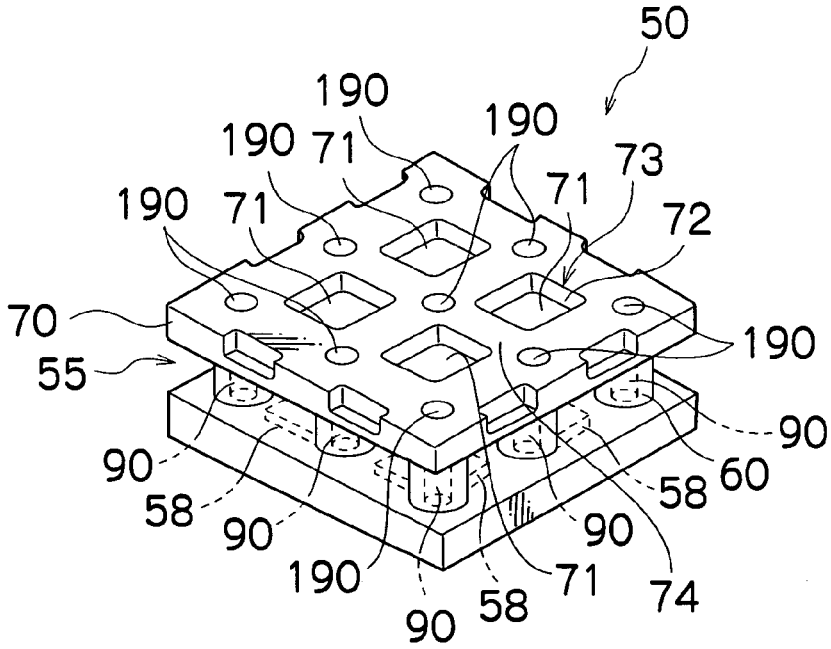
FIG. 8 is an oblique perspective view showing the main components of a print head according to a first embodiment.
Figure 9:
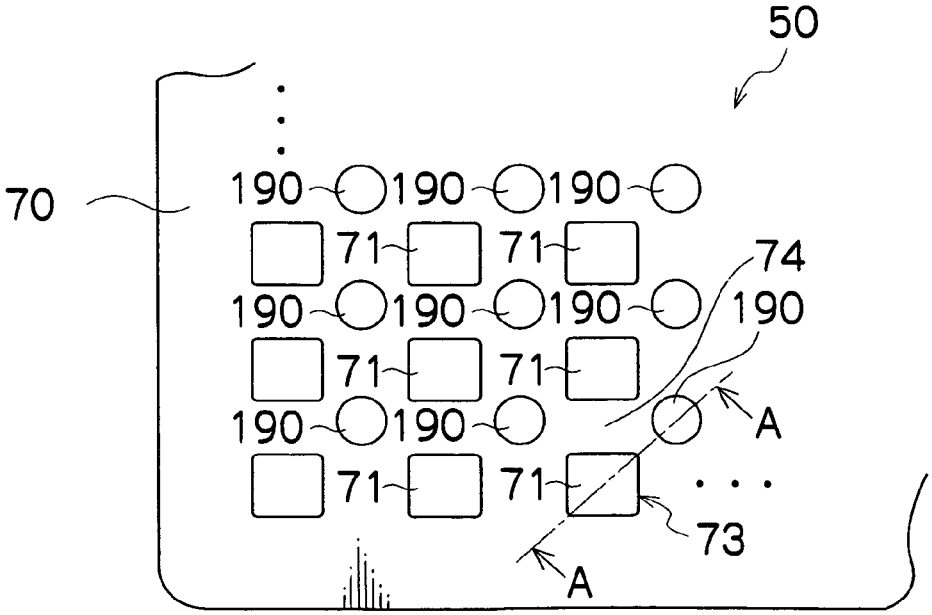
FIG. 9 is a plan view showing the main components of this print head according to the first embodiment.

FIG. 8 is a perspective view showing a portion of the print head 50 of the first embodiment, which is a liquid ejection head according to the present invention. In FIG. 8, in order to facilitate the explanation of the present invention, only the structure of the portion higher than the common liquid chamber 55 of the print head 50 is shown, and, in practice, as explained above with regard to FIG. 5, on the lower sides of a plurality of piezoelectric elements 58 which are arranged in a two-dimensional array, a plurality of pressure chambers 52 are arranged in one-to-one correspondence with this plurality of piezoelectric elements 58, i.e., also in a two-dimensional array, with a diaphragm 56 intervening between them. Furthermore, a plan view of this print head 50 is shown in FIG. 9.

As shown in FIG. 8, the upper surface of the common liquid chamber 55 is constituted by a ceiling plate 70. On the upper surface of this ceiling plate 70, there are exposed the end portions 190 of a plurality of electrical wires 90 which stand erect substantially vertically within the common liquid chamber 55, and these constitute external side electrodes 190 for supplying drive signals for the piezoelectric elements 58 from an exterior source such as a flexible cable or the like. These external side electrodes 190 are arranged in a two-dimensional array on the ceiling plate 70.

On the other hand, on the ceiling plate 70 there are arranged in a two-dimensional array a plurality of recess portions 73, each comprising a thin layer 71 and side walls 72. To put it in another manner, the plurality of thin layers 71 are formed in a two-dimensional array on the upper surface of the common liquid chamber 55, so as to contact the ink within the common chamber 55.

These recess portions 73 are arranged on the ceiling plate 70 so as to form a lattice shaped cross beam structure 74 on the ceiling plate 70; this cross beam structure 74 is constituted by neighboring ones of the end portions 190 of the electrical wires 90 being connected to one another. In other words, the lattice shaped cross beam structure 74 and the plurality of thin layers 71 are demarcated on the ceiling plate 70 by the side walls 72, which act as boundaries, and which are formed so as to drop substantially vertically, or at a slant, from the upper surface of the ceiling plate 70. On the one hand, this cross beam structure 74 ensures the rigidity of the print head 50, while, on the other hand, as will be explained in detail hereinafter, the plurality of thin layers 71 reset the pressures which are propagated so as to flow in reverse from the pressure chambers 52 towards the common liquid chamber 55.

Figure 10:
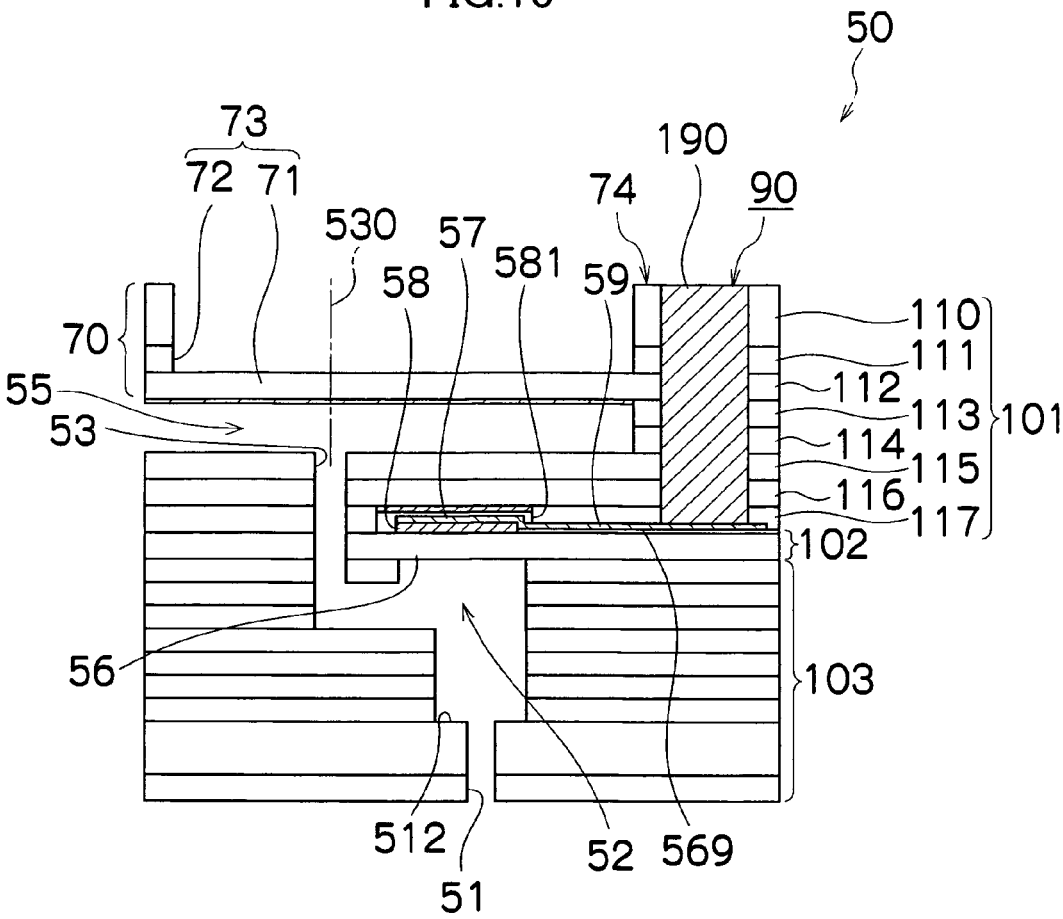
FIG. 10 is a sectional view of this print head, along the line A-A in FIG. 9.

A sectional view of this print head along the line A-A in FIG. 9 is shown in FIG. 10.

Figure 11:
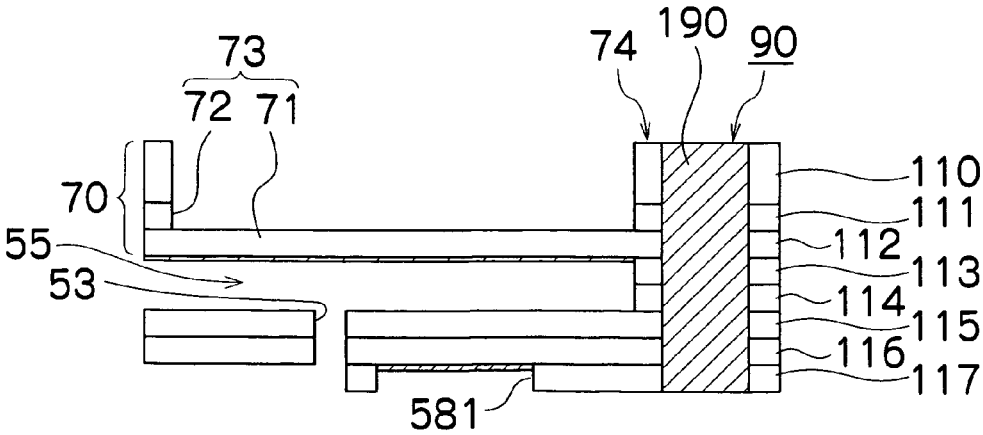
FIG. 11 is a sectional view showing an upper portion structural member of this print head according to the first embodiment.
Figure 12:
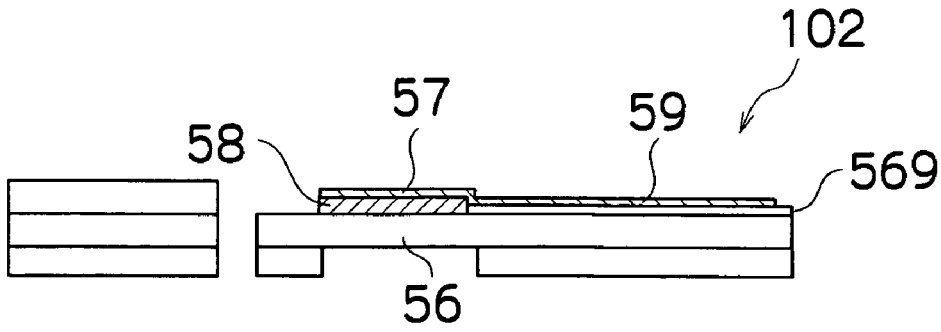
FIG. 12 is a sectional view showing a middle portion structural member of this print head.
Figure 13:
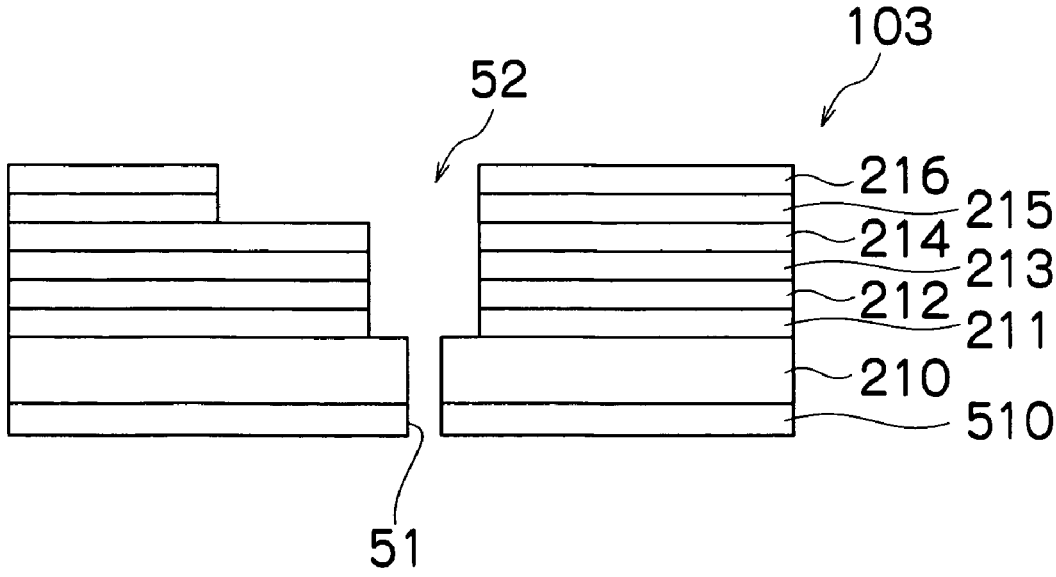
FIG. 13 is a sectional view showing a lower portion structural member of this print head.

The print head 50 shown in FIG. 10 comprises an upper portion structural member 101 shown in FIG. 11, a middle portion structural member 102 shown in FIG. 12, and a lower portion structural member 103 shown in FIG. 13, all three of which are joined together.

The upper portion structural member 101 comprises, as principal components: a plurality of recess portions 73 which comprise thin layers 71 and side walls 72; a cross beam structure 74 which is constituted by neighboring ones of end portions 190 of electrical wires 90 being connected to one another; a common liquid chamber 55 which communicates with a plurality of pressure chambers 52 via ink supply ports 53; and the plurality of electrical wires 90 which supply drive signals to piezoelectric elements 58. This upper portion structural member 101 is formed using photolithography, by laminating layers 111 through 117 of photosensitive resin to a substrate 110 which is made from a glass epoxy resin, as will be described in detail hereinafter.

The middle portion structural member 102 comprises, as principal components: a diaphragm 56 (which also serves as a common electrode); a plurality of piezoelectric elements 58 which are disposed on top of the diaphragm 56; a plurality of individual electrodes 57; and a plurality of electrode pads 59 (interior side electrodes), each of which is extended from one of the plurality of individual electrodes 57. It should be understood that insulation layers 569 are formed between the diaphragm 56 and the electrode pads 59.

The lower portion structural member 103 comprises, as principal components, a plurality of pressure chambers 52 and a plurality of nozzles 51. Just like the upper portion structural member 101, this lower portion structural member 103 is made using photolithography, by laminating layers of photosensitive resin to a predetermined substrate.

It should be understood that, since the structure of the print head 50 has been shown in detail in FIG. 10, only ones of the nozzles 51, the pressure chambers 52, the individual electrodes 57, the piezoelectric elements 58, the electrode pads 59, the recess portions 73, and the electrical wires 90 are shown; but, in actual practice, each of these is provided in plurality to the print head 50, and they are arranged as previously described.

The lower sides of the plurality of pressure chambers 52 are defined by nozzle surfaces 512 in which the plurality of nozzles 51 are formed, while the diaphragm 56 defines their upper sides; so that these pressure chambers 52 are defined as being sandwiched between these sides 512 and 56.

The common liquid chamber 55 is defined on the other side of the diaphragm 56 from the one on which the plurality of pressure chambers 52 are defined.

The plurality of electrical wires 90 are formed in an substantially perpendicular direction with respect to the horizontal planes of the diaphragm 56, the substrates 110, and the photosensitive resin layers 111 through 117, by members made from electrically conductive material being embedded in the interior of the upper portion structural member 101 which includes the lamination of the photosensitive resin layers 111 through 117 to the substrate 110, so as to extend in the vertical direction.

Each of the plurality of thin layers 71 is formed so as to be orthogonal to the axis 530 of each of the ink supply ports 53 which supply ink to the pressure chambers 52 from the common liquid chamber 55 (i.e., so as to be roughly parallel to the surface on which the plurality of piezoelectric elements 58 are arranged). To put it in another manner, each of these thin layers 71 comprises a surface which is opposed to the opening cross section of the corresponding ink supply port 53.

Furthermore, the upper surfaces of the thin layers 71 (which are their opposite surfaces from their liquid contact surfaces) are in contact with the atmosphere, and are made so that atmosphere pressure bears on the ink supply ports 53 without modification.

It should be understood that although, in the case of atmospheric pressure, the pressure is sufficiently lower than the pressure of the ink in the common liquid chamber 55, and furthermore this is preferable from the point of view of simplicity, on the other hand, setting it to a low pressure below atmospheric pressure is preferable, from the point of view of performance in resetting the pressure.

Moreover, although it is necessary to make the thin layers 71 apply tension to the ink if they are to function as dampers, in this embodiment, they are not endowed with any such function as dampers, and thus, since they are only devices for resetting the pressure which is propagated so as to flow back from the pressure chambers 52 via the ink supply ports 53 to the common liquid chamber 55, accordingly they are made to be in a state which does not apply any tension to the ink. In this embodiment, firstly, the thin layers 71 are formed substantially perpendicular with respect to the axes 530 of the supply ports 53 (i.e., substantially parallel with respect to the surfaces on which the piezoelectric elements 58 are arranged), and so that the weight of the ink within the common liquid chamber 55 (which is the pressure which, in FIG. 10, acts from above in the downward direction) does not bear on the thin layers 71. Secondly, the thin layers 71 are formed so that atmospheric pressure bears on the ink supply ports 53 without modification. Thirdly, the thin layers 71 are formed as the single thin resin layers 112. With this type of structure, a state in which no tension bears on the ink is ensured. Here, the concept of no tension bearing on the ink is intended to include, both a non-uniform state of tension, and a state in which the liquid contact surface is slack.

With this type of thin layers 71 which are in a state in which no tension bears on the ink, the pressure which propagates so as to flow in reverse from the pressure chambers 52 via the ink supply ports 53 to the common liquid chamber 55 is absorbed with good efficiency by the closest confronting surfaces to the ink supply ports 53. In other words, the pressure almost comes to be reset.

It should be understood that although, by way of example, the resin layers 111 through 117 are shown in FIGS. 10 and 11 as being made to be of the same thickness, it would also be acceptable to set the thickness of the resin layer 112 which constitutes the thin layer 71 appropriately in consideration of its resistance to breakage and its functionality for pressure resetting, while making the other resin layers 111 and 113 through 117 of different thickness.

Next, an example of a method for manufacturing the print head 50 of the first embodiment shown in FIGS. 8 through 10 will be explained.

FIGS. 14A to 14G, FIGS. 15A to 15E, and FIGS. 16A to 16D are explanatory drawings showing a manufacturing process for the upper portion structural member 101 of the print head 50 shown in FIG. 11. It should be understood that FIGS. 14A to 14G principally shows a manufacturing process for forming the ceiling plate 70 which comprises the recess portions 73 and the cross beam structure 74, FIGS. 15A to 15E principally shows a manufacturing process for forming the common liquid chamber 55, and FIGS. 16A to 16D principally shows a manufacturing process for forming a piezoelectric element protective portion 581 which protects the piezoelectric element 58. It should be understood that the electrical wires 90 are made gradually, during the manufacturing processes shown in FIGS. 14A through 16D.

Figure 14A:
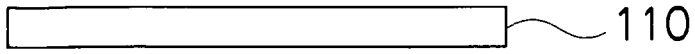
FIGS. 14A to 14G are first explanatory drawings for explanation of a manufacturing process for the first embodiment print head.

First, as shown in FIG. 14A, a substrate 110 made from glass epoxy resin is prepared.

Figure 14B:
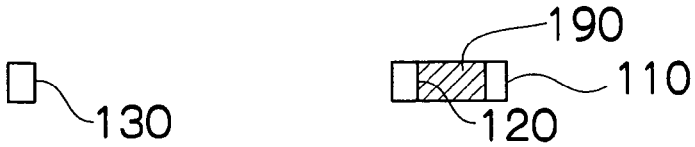

Next, as shown in FIG. 14B, opening portions 120 for the electrical wires 90 and opening portions 130 which are to constitute portions of the side walls 72 of the recess portions 73 are formed for the substrate 110. The manufacture of both of the opening portions 120 and 130 may be performed, for example, by a method of laser processing, pressing, drilling, sandblasting, or the like. The external side electrodes 190 of the electrical wires 90 are formed in the opening portions 120 for the electrical wires 90 by embedding an electrically conductive filling material in them by a plating process, or by filling them with an electrically conductive paste or the like.

Figure 14C:
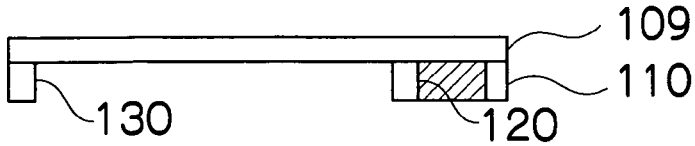

Next, as shown in FIG. 14C, a protective layer 109 which will be removed later is formed on one surface (the upper surface in FIGS. 14A to 14G) of the substrate 110. For example, an adhesive of which adhesive force is deactivated by irradiation with ultraviolet radiation may be used.

Figure 14D:
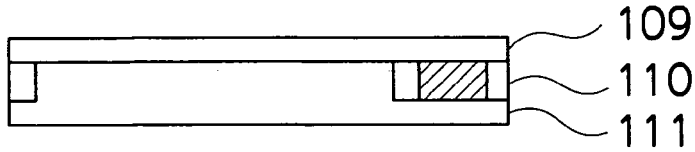

Next, as shown in FIG. 14D, the first resin layer 111 is formed by thinly coating the other side surface (the lower surface in FIGS. 14A to 14G) of the substrate 110 with a photosensitive resin by a spin coating method or the like.

Figure 14E:
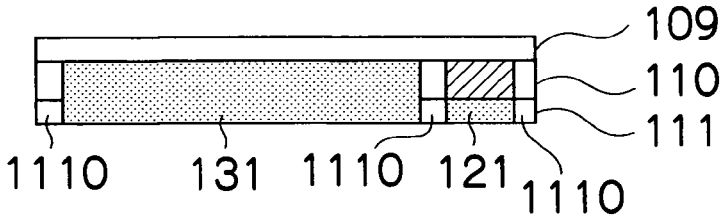

Next, as shown in FIG. 14E, portions 1110 which are insoluble in development fluid and portions 121 and 131 which are soluble in development fluid are formed separately by exposing light onto the first resin layer 111 via a mask. In more detail, there are formed: development fluid insoluble portions 1110 which, by not subsequently dissolving in development fluid, leave the cross beam structure 74 remaining; development fluid soluble portions 121 for the electrical wires 90 which, by subsequently dissolving in the development fluid, are filled up with an electrically conductive material; and development fluid soluble portions 131 for the recess portions 73, which subsequently dissolve in the development fluid.

It should be understood that the range of formation in a horizontal plane of the openings of the recess portions 73 (in other words, the opening portions 130 of the substrate 110 for the recess portions 73 and the development fluid soluble portions 131 of the first resin layer 111 for the recess portions 73) is set so as to include the positions in the horizontal plane of the ink supply ports 53 which will be manufactured in a subsequent procedure. Furthermore, the ratio between the cross sectional area of the openings for the recess portions 73 and the area of the cross beam structure 74 is set to an appropriate ratio, in consideration of the rigidity to be imparted to the resulting print head 50, and the degree of resetting of the pressure.

Figure 14F:
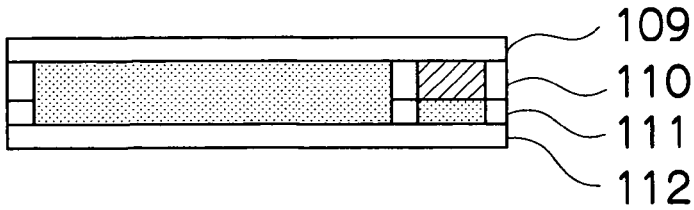

Next, as shown in FIG. 14F, the second resin layer 112 is formed by thinly coating the first resin layer 111 with a photosensitive resin.

Figure 14G:
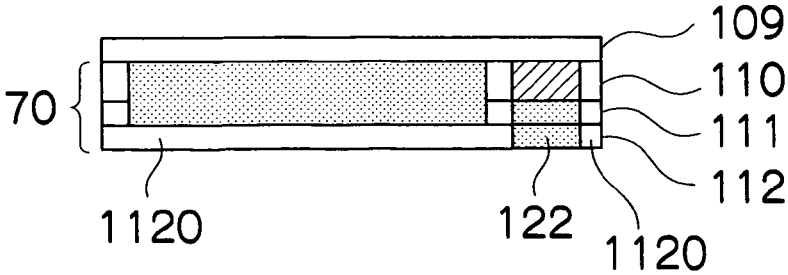

Next, as shown in FIG. 14G, development fluid insoluble portions 1120 which are to remain as the thin layers 71 and development fluid soluble portions 122 for the electrical wires 90 are formed by exposing light onto the second resin layer 112 via a mask.

It should be understood that the thickness of the thin layers 71 (in other words, the thickness of the second resin layer 112) is set to a suitable thickness of an order at which tension does not bear on the ink within the common liquid chamber 55, and is also set in consideration of its resistance to rupture. The numerical value of such a suitable thickness for the thin layers 71 may also differ, according to the components of the resin and the like.

Figure 15A:
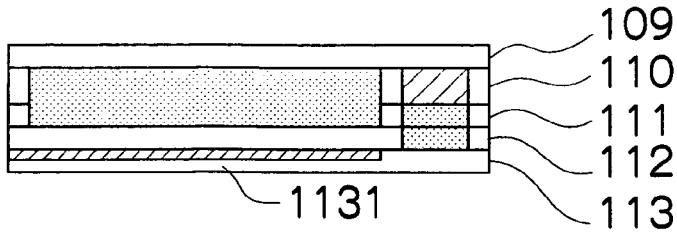
FIGS. 15A to 15E are second explanatory drawings for explanation of a manufacturing process for the first embodiment print head.
Figure 15B:
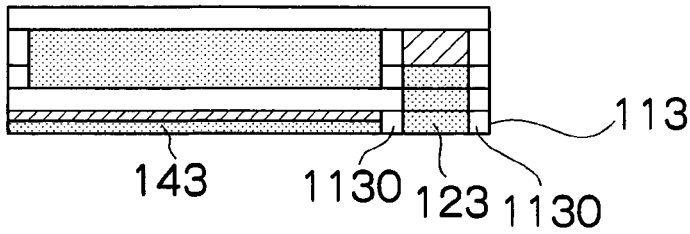
Figure 15C:
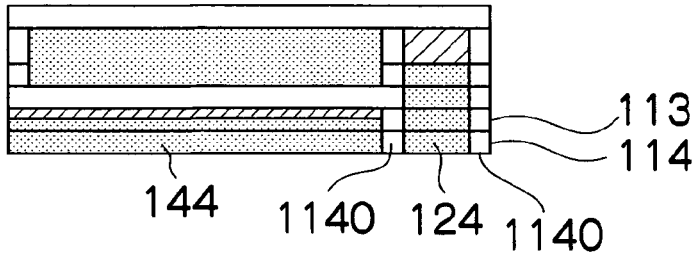

Next, as shown in FIG. 15A, after having formed an exposure protection layer 1131 (which is a layer which protects portions of the thin layer 71 from exposure) on the second resin layer 112, the third resin layer 113 is formed by thinly coating the second resin layer 112 with a photosensitive resin, and, as shown in FIG. 15B, by exposing it to light via a mask, development fluid soluble portions 123 for the electrical wires 90, development fluid insoluble portions 1130 for leaving insulating members so as to constitute the peripheral portions 60 for them, and development fluid soluble portions 143 for the common liquid chamber 55, are formed separately. In the same manner, as shown in FIG. 15C, the fourth resin layer 114 is formed, and development fluid insoluble portions 1140 and development fluid soluble portions 124 and 144 are formed separately.

Figure 15D:
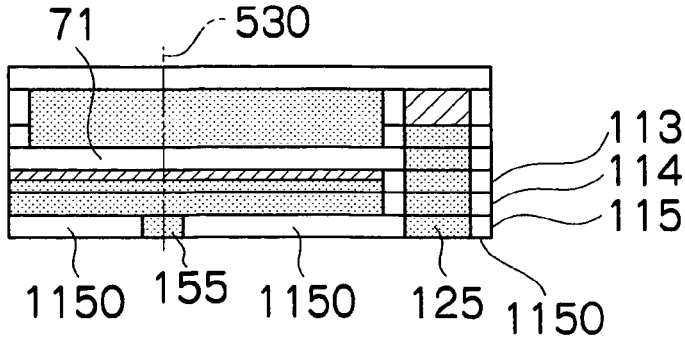

Next, as shown in FIG. 15D, the fifth resin layer 115 is formed by a thin coating of photosensitive resin, and development fluid soluble portions 125 for the electrical wires 90, development fluid soluble portions 155 for the ink supply ports 53, and development fluid insoluble portions 1150 are formed separately from one another. It should be understood that the axes of the thin layers 71 and of the ink supply ports 53 are formed so as to be mutually orthogonal.

Figure 15E:
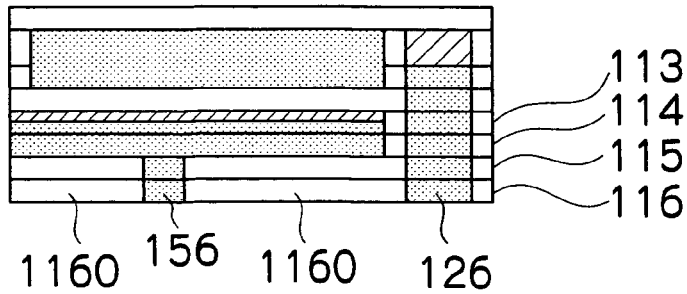

As shown in FIG. 15E, the sixth resin layer 116 is formed in the same manner as the fifth resin layer 115, and development fluid soluble portions 126 and 156 and development fluid insoluble portions 1160 are formed separately from one another.

Figure 16A:
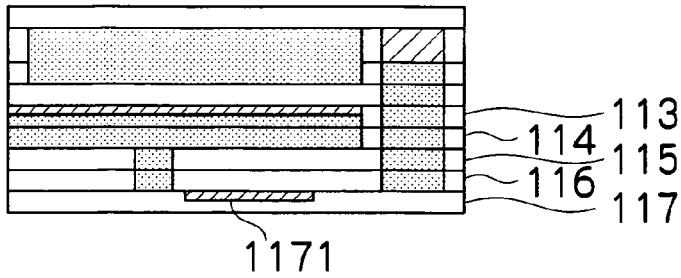
FIGS. 16A to 16D are third explanatory drawings for explanation of a manufacturing process for the first embodiment print head.
Figure 16B:
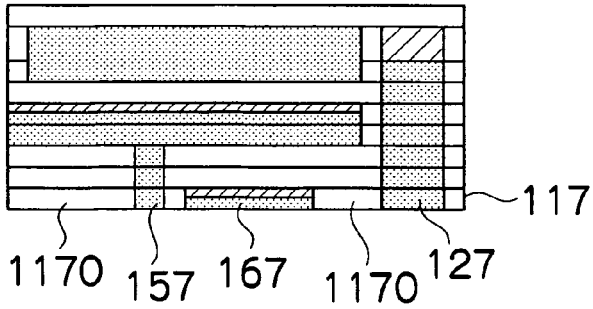

Next, as shown in FIG. 16A, after forming an exposure protection layer 1171 (which is a layer for protecting the upper surface of the piezoelectric elements 58 from exposure), the seventh resin layer 117 is formed by thinly coating the sixth resin layer 116 with a photosensitive resin on, and, as shown in FIG. 16B, by exposing it to light via a mask, development fluid soluble portions 127 for the electrical wires 90, development fluid soluble portions 167 for the piezoelectric elements 58, development fluid soluble portions 157 for ink supply, and development fluid insoluble portions 1170 are formed separately from one another.

Figure 16C:
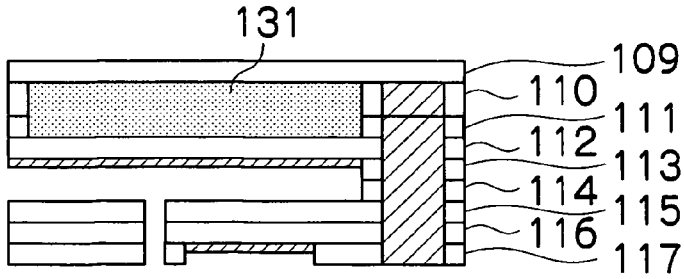

Next, as shown in FIG. 16C, the portions of the third resin layer 113 through the seventh resin layer 117 which are soluble in the development fluid are dissolved using the development fluid.

Figure 16D:
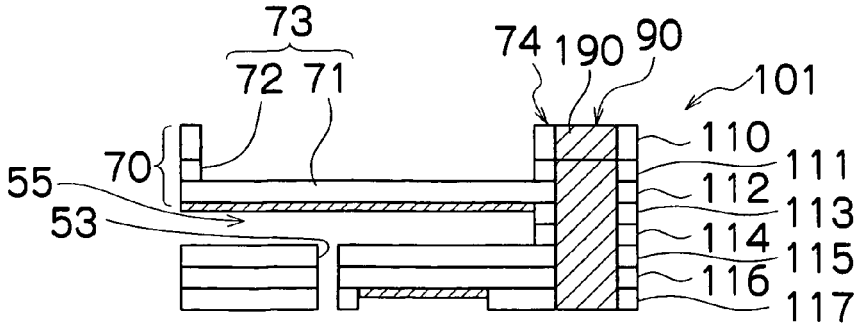

Next, the protective layer 109 which has been formed on the upper surface of the substrate 110 is removed, and the remaining development fluid soluble portions 131 are dissolved with development fluid. When this is done, the upper portion structural member 101 is formed, as shown in FIG. 16D.

The middle portion structural member 102 shown in FIG. 12 is made, for example, by forming a pattern over a green sheet layer, and, after calcination, manufacturing the piezoelectric elements 58 by an aerosol deposition (AD) method or a spattering method, and by further performing annealing or the like.

The lower portion structural member 103 shown in FIG. 13 is made by laminating photosensitive resin layers 211 through 216 to a predetermined substrate 210, with the pressure chambers 52 being formed by using photolithography. Furthermore, a nozzle plate 510 is attached to the substrate 210 on its other side from the one on which the resin layers 211 through 216 are laminated. This nozzle plate 510 may be adhered to the substrate 210 after the resin layers 211 through 216 have been laminated thereon, or, alternatively, an laminate protective layer may be adhered to the substrate 210 before laminating the resin layers 211 through 216 thereon, and in this case, after laminating the resin layers 211 through 216, this laminate protective layer is removed, and instead the nozzle plate 510 is adhered to the substrate 210. The nozzles 51 are formed on the nozzle plate 510 at high accuracy in predetermined positions.

And, when the upper portion structural member 101 shown in FIG. 11, the middle portion structural member 102 shown in FIG. 12, and the lower portion structural member 103 shown in FIG. 13 are joined together, the print head 50 shown in FIG. 10 is obtained.

Figure 17:
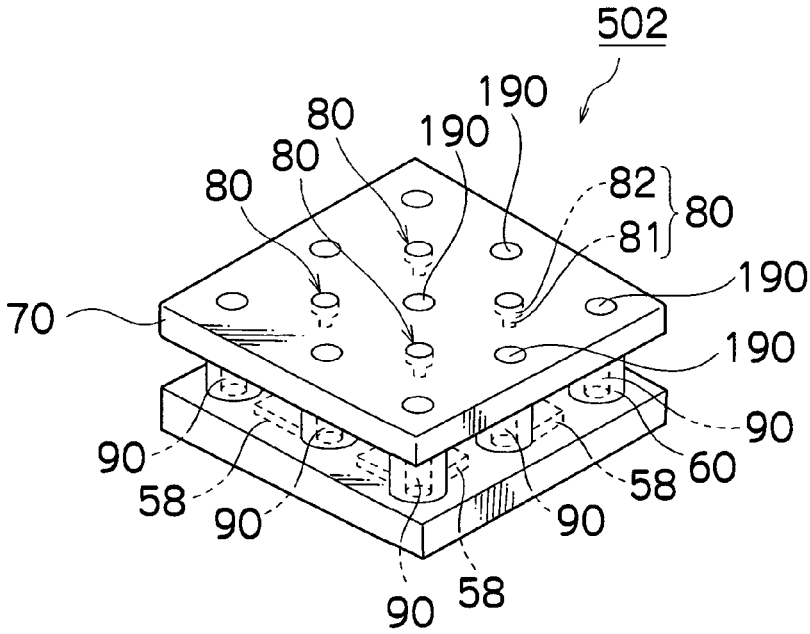
FIG. 17 is a perspective view showing the principal portions of a print head according to a second embodiment.
Figure 18:
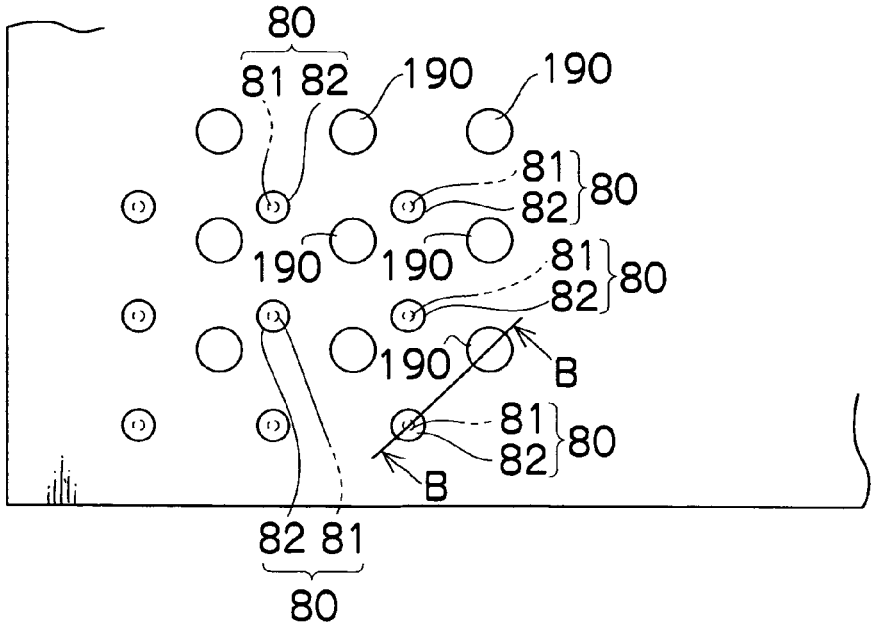
FIG. 18 is a plan view showing the principal portions of a print head according to the second embodiment.
Figure 19:
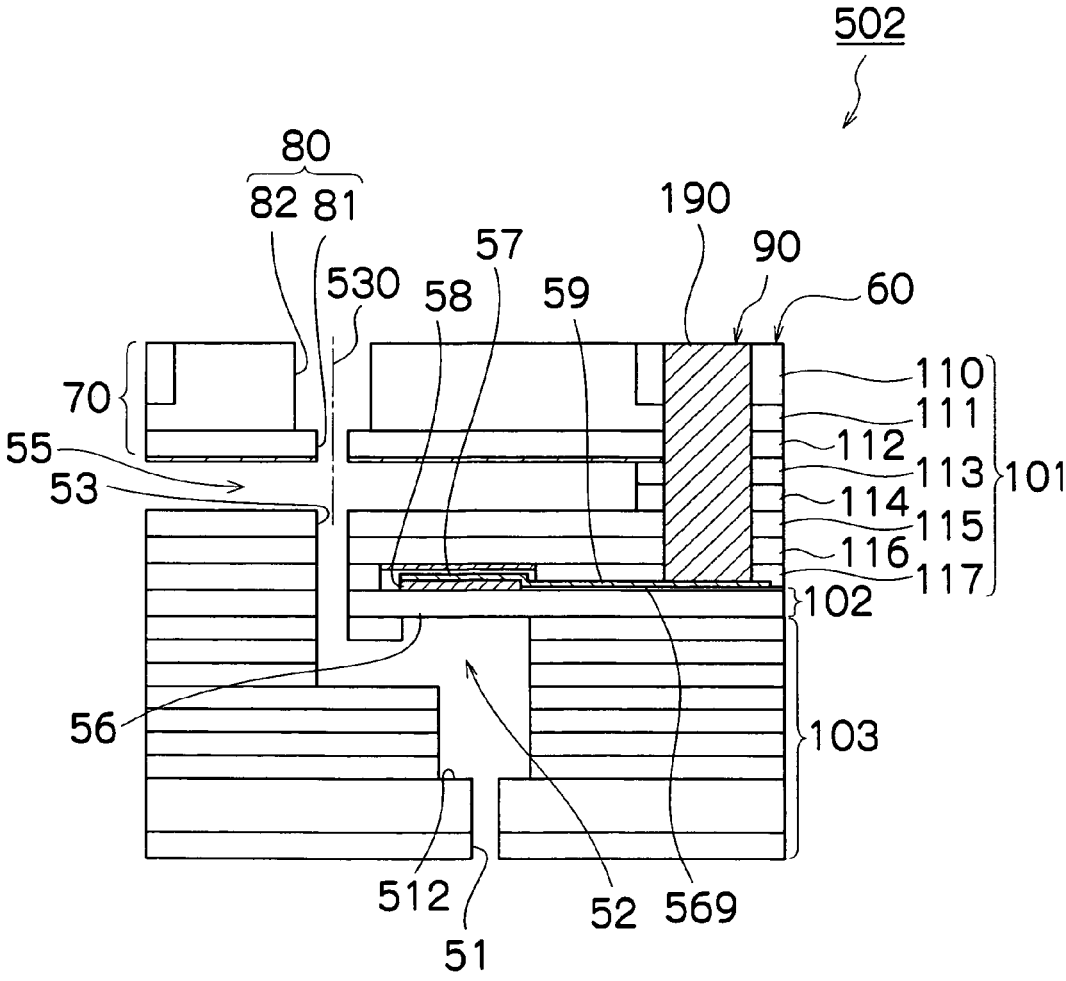
FIG. 19 is a sectional view of this print head, along the line B-B in FIG. 18.

FIG. 17 is a perspective view showing a portion of a print head 502, which is a second embodiment of the liquid ejection head according to the present invention. And a plan view of this print head 502 is shown in FIG. 18, while a sectional view along the line B-B in FIG. 18 is shown in FIG. 19. It should be understood that, in FIG. 17 through FIG. 19, to structural elements which are the same as ones of the first embodiment print head 50 shown in FIG. 8 through FIG. 10, the same reference numerals are appended, and the detailed explanation thereof will be curtailed, since it has already been given for the first embodiment.

In FIG. 17, in order to simplify the explanation of the present invention, only the structure of the portion of the print head 502 above the common liquid chamber 55 is shown, but, in actual practice, as already explained with reference to FIG. 5, a plurality of piezoelectric elements 58 are arranged on the upper side of a diaphragm 56 in a two-dimensional array, while a plurality of pressure chambers 52 are defined on the other, lower side of the diaphragm 56 in one-to-one correspondence with these piezoelectric elements 58.

In this print head 502 according to the second embodiment, instead of providing the thin layer 71 to the ceiling plate 70 as is the case with the print head 50 of the first embodiment, a plurality of atmospheric communication apertures 80, which communicate with the atmosphere, are arranged on the ceiling plate 70 in a two-dimensional array. To put it in another way, the plurality of atmospheric communication apertures 80 are formed in the upper surface of the common liquid chamber 55 in contact with the ink in the common liquid chamber 55.

Each one of this plurality of atmospheric communication apertures 80, as shown in FIG. 17 and FIG. 19, comprises a small diameter portion 81 (an iris portion) which is formed at the lower surface of the ceiling plate 70 (i.e., at its liquid contact surface), and a large diameter portion 82 which is formed at the upper surface side of the ceiling plate 70 (i.e., at its atmosphere surface).

The small diameter portion 81 of the atmospheric communication aperture 80 is smaller in diameter than the nozzle 51; this portion has a diameter of such a size that, when ink droplets are ejected from the nozzle 51 by deformation of the pressure chamber 52, no droplets of the ink within the common liquid chamber 55 are ejected from the atmospheric communication aperture 80. Furthermore, the large diameter portion 82 of this atmospheric communication aperture 80 has a larger diameter than that of the small diameter portion 81.

As shown in FIG. 19, the print head 502 of this second embodiment is formed by joining together an upper portion structural member 1012, a middle portion structural member 102, and a lower portion structural member 103.

The upper portion structural member 101 comprises, as principal components, the atmospheric communication aperture 80, the common liquid chamber 55, and an electrical wire 90. Since the middle portion structural member 102 and the lower portion structural member 103 are the same as in the first embodiment, and have already been explained in connection with that first embodiment, detailed explanation thereof will be curtailed.

As shown in FIG. 19, each of the plurality of atmospheric communication apertures 80 is formed along the axis 530 of the corresponding ink supply port 53 for supplying ink from the common liquid chamber 55 to the corresponding pressure chamber 52. To put it in another manner, each of the atmospheric communication apertures 80 is disposed in the closest position within the common liquid chamber 55 to oppose the corresponding ink supply port 53.

The axis of this atmospheric communication aperture 80 is formed substantially parallel to the axis of its corresponding supply port 53 (i.e., substantially perpendicular to the surface on which the plurality of piezoelectric elements 58 are arranged), and accordingly the weight of the ink within the liquid chamber 55 (which is a pressure which acts from up to down in FIG. 19) does not bear on the atmospheric communication aperture 80; and, moreover, the aperture 80 is made so that the atmospheric pressure bears on the ink supply port 53 without modification. With this type of atmospheric communication aperture 80, the pressures which are propagated so as to flow in the reverse direction from the pressure chambers 52 via the ink supply ports 53 to the common liquid chamber 55 are absorbed at the closest points to the ink supply ports 53, and moreover at good efficiency. In other words, the pressures come to be almost reset.

Furthermore, as shown in FIG. 19, by manufacturing the small diameter portion 81 of the atmospheric communication aperture 80 in only the single resin layer 112, this delicate process can be performed easily and simply. In other words, it is possible to manufacture the atmospheric communication apertures 80 for pressure resetting in a simple and easy manner during the process of laminating the resin layers 111 through 117 and making the electrical wires 90 which pass substantially vertically through the common liquid chamber 55. In detail, on the one hand the manufacture of the pillar shaped electrical wires 90 can be performed more simply and easily by laminating the resin layers together (so-called resin buildup); and moreover, if it is supposed that the minute atmospheric communication apertures 80 of which diameter is smaller than that of the nozzles 51 are to be formed at a sufficient processing accuracy for them to be able to reset the pressure, then, rather than forming these minute apertures while mutually aligning the axes of these minute holes which extend over a plurality of resin layers, and making minute holes in the relatively thick substrate 110 rather than in a resin layer made with a resist which is made from glass epoxy resin, it is possible to manufacture the entire device in a much simpler and easier manner by making, on the one hand, the small diameter portion 81, for which very fine accuracy is required, in the single resin layer 112, and by making, on the other hand, the large diameter portion 82 in the substrate 110 and in the other resin layer 111, together with performing the processing for manufacturing the electrical wires 90 and the processing for manufacturing the atmospheric communication apertures 80 together.

When the method of manufacturing this print head 502 according to the second embodiment is compared with the method of manufacturing the print head 50 according to the first embodiment explained above using FIGS. 14A to 14G through FIGS. 16A to 16D, it will be understood that the process for forming the ceiling plate 70 is different. In detail, with the print head 50 of the first embodiment, in the manufacturing process for forming the ceiling plate 70 shown in FIGS. 14A to 14G, the thin layers 71 are formed with the substrate 110 and the resin layers 111 and 112; but, with the print head 502 according to the second embodiment, in the manufacturing process for forming the ceiling plate 70, on the one hand the large diameter portions 82 of the atmospheric communication apertures 80 are formed in the substrate 110 and the first resin layer 111, while on the other hand the small diameter portions 81 of the atmospheric communication apertures 80 are formed in the second resin layer 112. Since the subsequent manufacturing processes, are almost the same as those in the first embodiment explained above with reference to FIGS. 15A to 15E and FIGS. 16A to 16D, further explanation thereof will be curtailed.

It should be understood that although, in FIG. 19, by way of example, the case is shown in which each of the resin layers 111 through 117 is made to be of substantially the same thickness, it would also be acceptable to set the thickness of the resin layer 112 in which the small diameter portions 81 of the atmospheric communication apertures 80 are formed to an appropriate value, and to set the thicknesses of the other resin layers 111 and 113 through 117 to different values.

Figure 20:
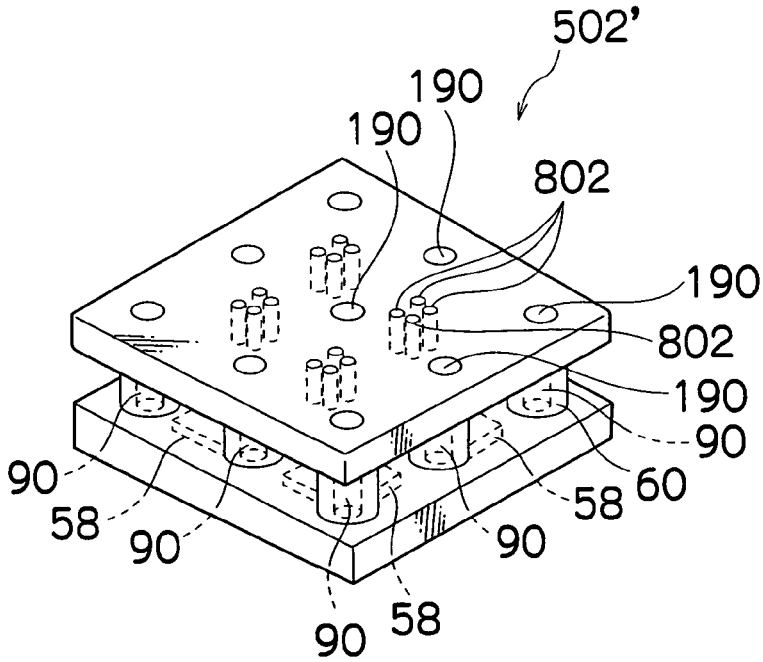
FIG. 20 is a perspective view showing the principal portions of another example of the print head according to the second embodiment.

Furthermore, with the print head 502 of the second embodiment shown in FIG. 17 through FIG. 19, although the case is shown, by way of example, that a single one of the atmospheric communication apertures 80 is formed for each of the pressure chambers 52 (in other words, that a single one of the atmospheric communication apertures 80 corresponds to each one of the ink supply ports 53), nevertheless, it would also be acceptable to form a group, for example four, of the atmospheric communication apertures 802 for each one of the ink supply ports 53, as for example shown in the case of the print head 502' of FIG. 20. In this print head 502' shown in FIG. 20, a group of four atmospheric communication apertures 802 is formed in the neighborhood of the axis of each of the ink supply ports 53.

Figure 21:
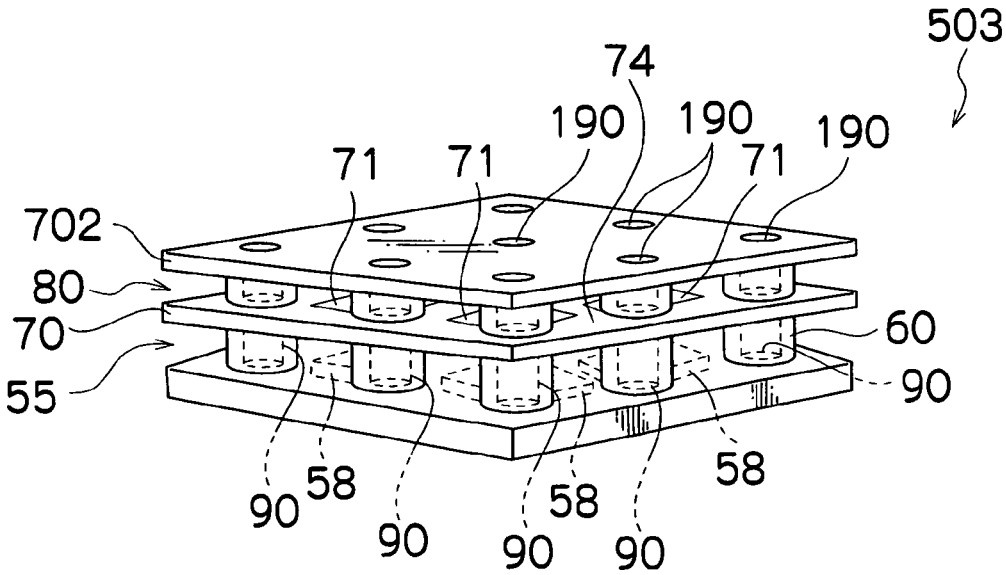
FIG. 21 is a perspective view showing the principal portions of a print head according to a third embodiment.
Figure 22:
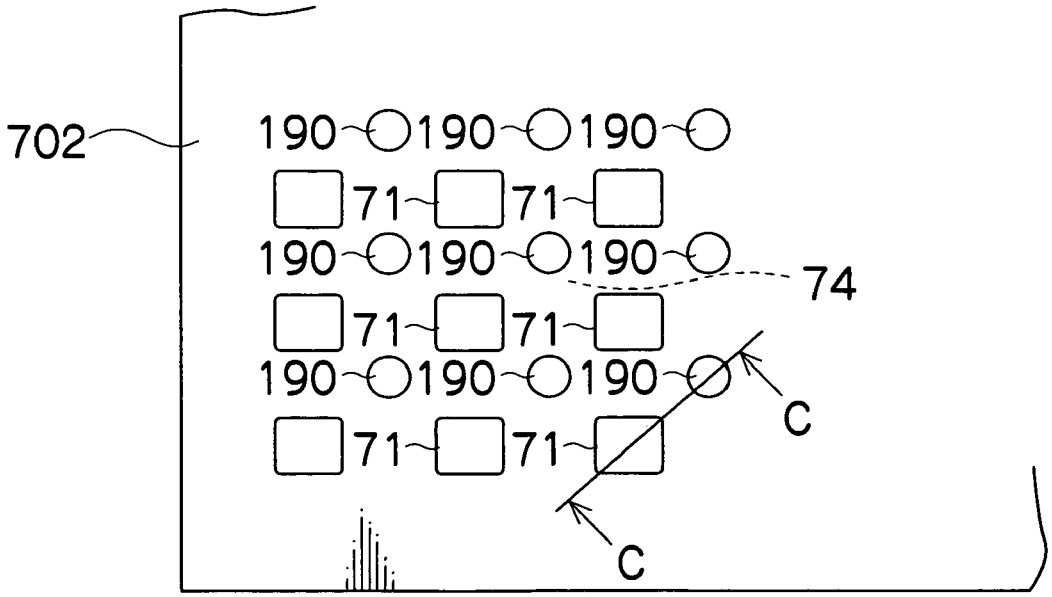
FIG. 22 is a plan view showing the principal portions of a print head according to the third embodiment.
Figure 23:
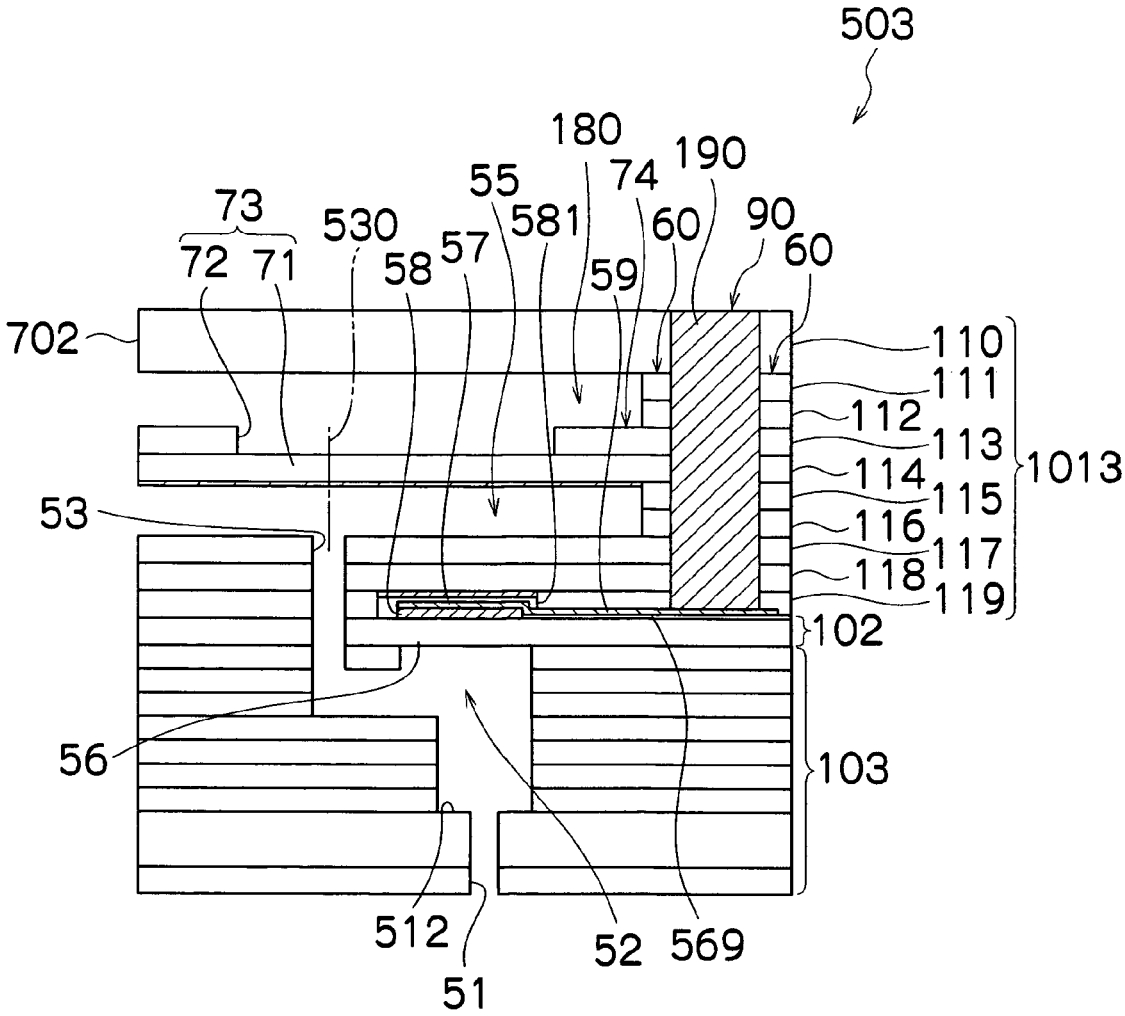
FIG. 23 is a sectional view of this print head, along the line C-C in FIG. 22.

FIG. 21 is a sectional view showing a portion of another print head 503, which is a liquid ejection head according the third embodiment of the present invention. A plan view of this print head 503 is shown in FIG. 22, while a sectional view thereof along the line C-C in FIG. 22 is shown in FIG. 23. It should be understood that, in FIG. 21 through FIG. 23, to structural elements which are the same as ones of the first embodiment print head 50 shown in FIG. 8 through FIG. 10, the same reference numerals are appended, and the detailed explanation thereof will be curtailed, since it has already been given for the first embodiment.

In FIG. 21, in order to simplify the explanation of the present invention, only the structure of the portion of the print head 503 above the common liquid chamber 55 is shown, but, in actual practice, as already explained with reference to FIG. 5, a plurality of piezoelectric elements 58 are arranged on the upper side of a diaphragm 56 in a two-dimensional array, while a plurality of pressure chambers 52 are defined on the other, lower side of the diaphragm 56 in one-to-one correspondence with these piezoelectric elements 58.

Just as in the first embodiment, thin layers 71 are provided in the ceiling plate 70 as arranged in a two-dimensional array. To express this in another way, the plurality of thin layers 71 are formed in a two-dimensional array in the upper surface of the common liquid chamber 55 which contacts the ink in the common liquid chamber 55.

A gas chamber 180 not only contacts the common liquid chamber 55 via the thin layers 71, but also communicates with the atmosphere via opening portions not shown in the drawings.

The end portions 190 (also termed external electrodes) of a plurality of electrical wires 90, which are erected so as to pass through the common liquid chamber 55 and the gas chamber 180, are exposed on the upper surface of a ceiling plate 702 of the gas chamber 180.

As shown in FIG. 23, the print head 503 of this third embodiment is formed by joining together an upper portion structural member 1013, a middle portion structural member 102, and a lower portion structural member 103.

The upper portion structural member 1013 comprises, as principal components, a gas chamber 180, a recess portion 73 which comprises a thin layer 71 and side walls 72, a common liquid chamber, and an electrical wire 90 and a peripheral member 60 thereof. Since the middle portion structural member 102 and the lower portion structural member 103 are the same as in the first embodiment, and have already been explained in connection with that first embodiment, detailed explanation thereof will be curtailed.

Each one of the plurality of thin layers 71 is formed so as to be orthogonal to the axes 530 of the ink supply ports 53 which supply the ink from the common liquid chamber 55 to the pressure chambers 52 (i.e., substantially parallel to the surface on which the plurality of piezoelectric elements 58 are arranged). In other words, each of the thin layers 71 is made as a surface which opposes the opening cross section of its corresponding one of the ink supply ports 53.

Furthermore, the upper surfaces of the thin layers 71 (which are their surfaces opposite to their liquid contact surfaces) are in contact with the external atmosphere, so that the structure is such that the atmospheric pressure bears on the ink supply ports 53 without modification. It should be understood that although, in the case of atmospheric pressure, this is lower than the pressure of the ink in the common liquid chamber 55 to a sufficient degree, and although furthermore this is preferable from the point of view of simplicity of application, it is more preferable to employ a pressure which is set to be lower than atmospheric pressure, from the point of view of enhancing performance of resetting the pressure.

Moreover, since the thin layers 71 are not made in order to function as dampers, but rather are devices for resetting the pressures which are propagated, against the flow of ink, from the pressure chambers 52 via the ink supply ports 53 into the common liquid chamber 55, accordingly they are made so as to ensure an operational state in which no tension bears on the ink (this includes both a state in which the tension is non-uniform, and a state in which the liquid contact surface is slack).

Next, a manufacturing method for the third embodiment print head 503 shown in FIG. 23 will be explained.

Figure 24A:
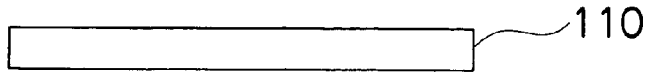
FIGS. 24A to 24G are explanatory drawings for explanation of a manufacturing process for the third embodiment print head.

A manufacturing process for the upper portion structural member 1013 will be explained with reference to FIGS. 24A to 24G First, as shown in FIG. 24A, a substrate 110 made from a glass epoxy resin is prepared.

Figure 24B:
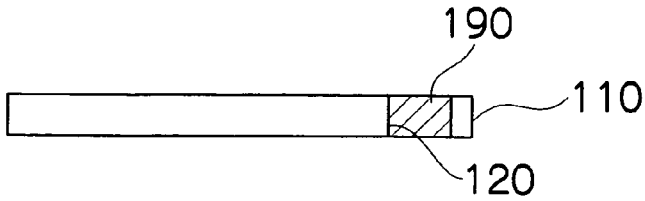

Next, as shown in FIG. 24B, opening portions 120 for the electrical wires 90 are formed in the substrate 110, and the external electrodes 190 of these electrical wires 90 are made by filling up an electrically conductive filling material into these opening portions 120.

Figure 24C:
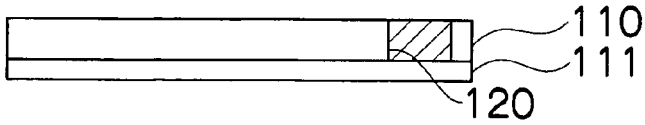

Next, as shown in FIG. 24C, the under side of this substrate 110 is coated with a photosensitive resin, so as to form the first resin layer 111.

Figure 24D:
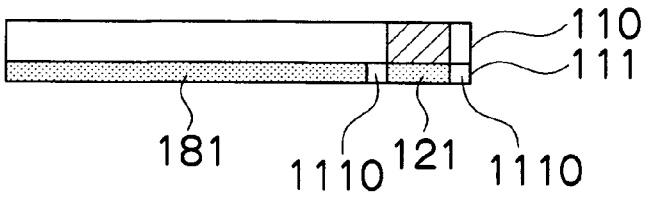

Next, as shown in FIG. 24D, a development fluid soluble portion 181 of which a portion is to become the gas chamber 180 by subsequently dissolving in development fluid, a development fluid soluble portion 121 for the electrical wire 90 which, after subsequently dissolving in development fluid, is to be charged with an electrically conductive material, and a development fluid insoluble portion 1110 which is to remain as an insulating member and will thus constitute the peripheral portion 60 of the electrical wire 90, are formed separately by exposing light onto the first resin layer 111 via a mask.

Figure 24E:
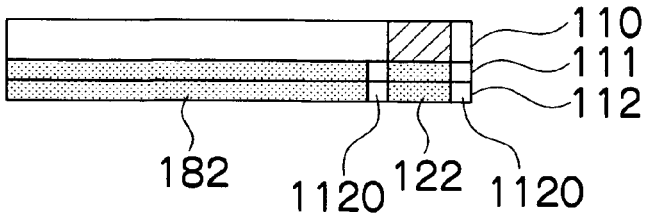

As shown in FIG. 24E, the second resin layer 112 is formed, and, just as with the first resin layer 111, development fluid soluble portions 182 and 122 and a development fluid insoluble portion 1120 are formed separately.

Figure 24F:
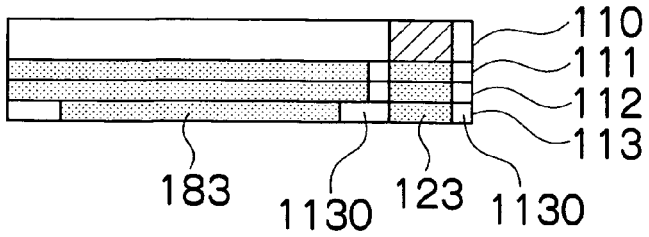

Next, as shown in FIG. 24F, by exposing the third resin layer 113 to light via a mask, a development fluid insoluble portion 1130 which is to remain as the cross beam structure 74, a development fluid soluble portion 123 for the electrical wire 90, and a development fluid soluble portion 183 which will become the aperture of the recess portion 73 are formed separately.

Figure 24G:
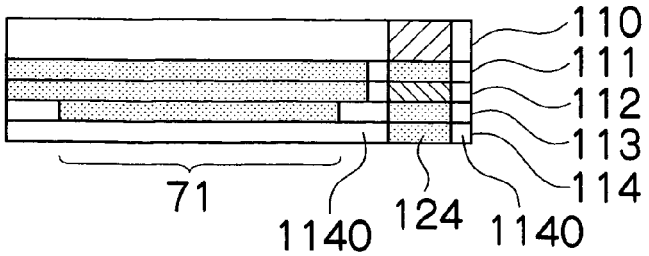

Next, as shown in FIG. 24G, the fourth resin layer 111 is formed, and, by exposing the fourth resin layer 114 to light via a mask, a development fluid insoluble portion 1140 which includes the thin layer 71, and a development fluid soluble portion 124 for the electrical wire 90 are formed separately.

Since the subsequent manufacturing process in which the common liquid chamber 55 is formed, and the subsequent manufacturing process in which the piezoelectric element protective portion 581 which protects the piezoelectric element 58 is formed, are the same as in the case of the first embodiment described above, the description thereof will be curtailed. Moreover, it goes without saying that, on the one hand, the ceiling plate 702 of the gas chamber 180 remains without being removed, while on the other hand the development fluid soluble portion within the gas chamber 180 is dissolved in the development fluid which flows in thereto via an opening portion not shown in the drawings and is eliminated.

Figure 25:
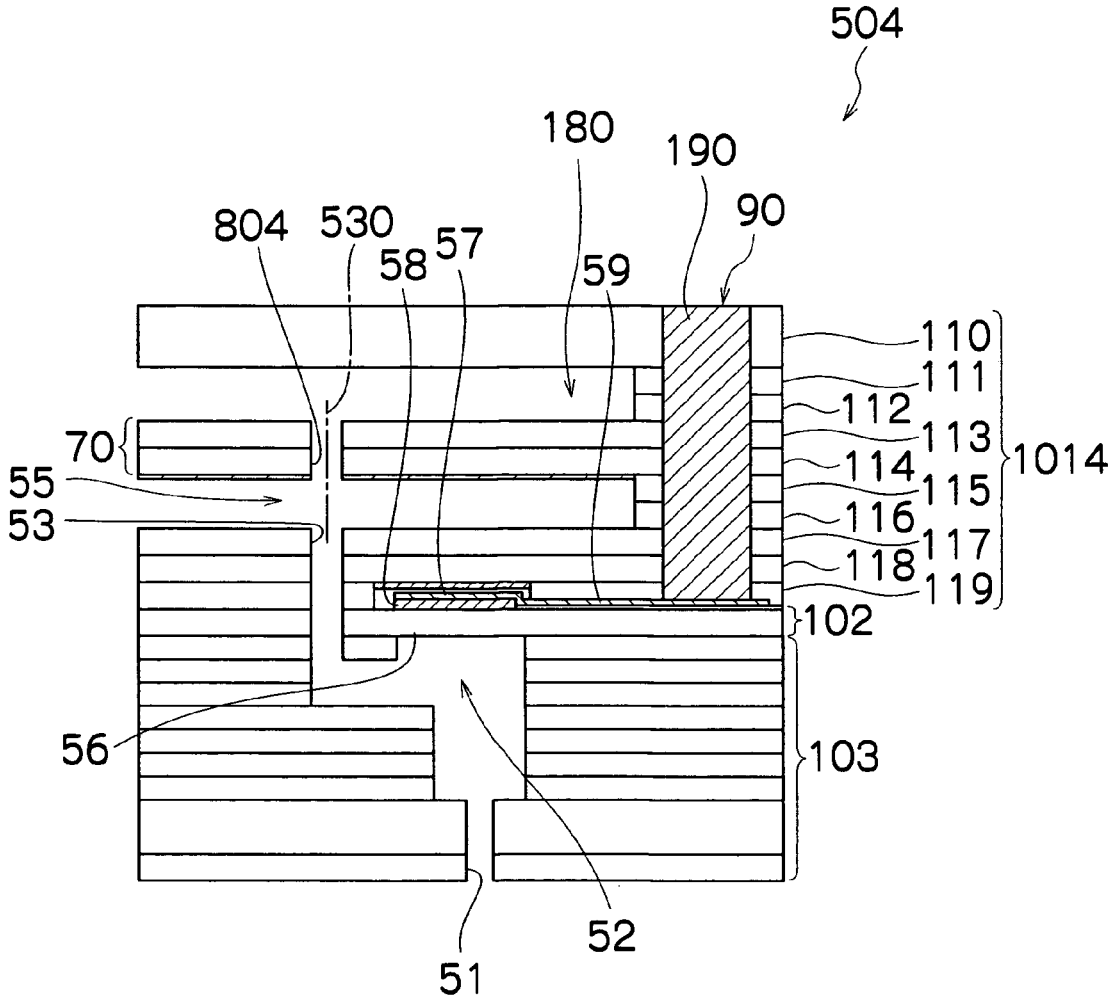
FIG. 25 is a sectional view showing the principal portions of a print head according to a fourth embodiment.

FIG. 25 is a sectional view showing a portion of a print head 504, which is a liquid ejection head according the fourth embodiment of the present invention.

In FIG. 25, to structural elements which are the same as ones of the third embodiment print head 503 shown in FIG. 23, the same reference numerals are appended, and the detailed explanation thereof will be curtailed.

With this print head 504 according to the fourth embodiment, a plurality of atmospheric communication apertures 804 which communicate with the external atmosphere are arranged in a two-dimensional array on the ceiling plate 70 of the common liquid chamber 55. These atmospheric communication apertures 804 are communicated with the gas chamber 180. Each of this plurality of atmospheric communication apertures 804 is formed on the axis 530 of its corresponding one of the ink supply ports 53 for supplying ink from the common liquid chamber 55 to the corresponding one of the pressure chambers 52. To express it in another manner, the atmospheric communication apertures 80 are arranged in the positions most closely opposing the corresponding ones of the ink supply ports 53 within the common liquid chamber 55.

Figure 26:
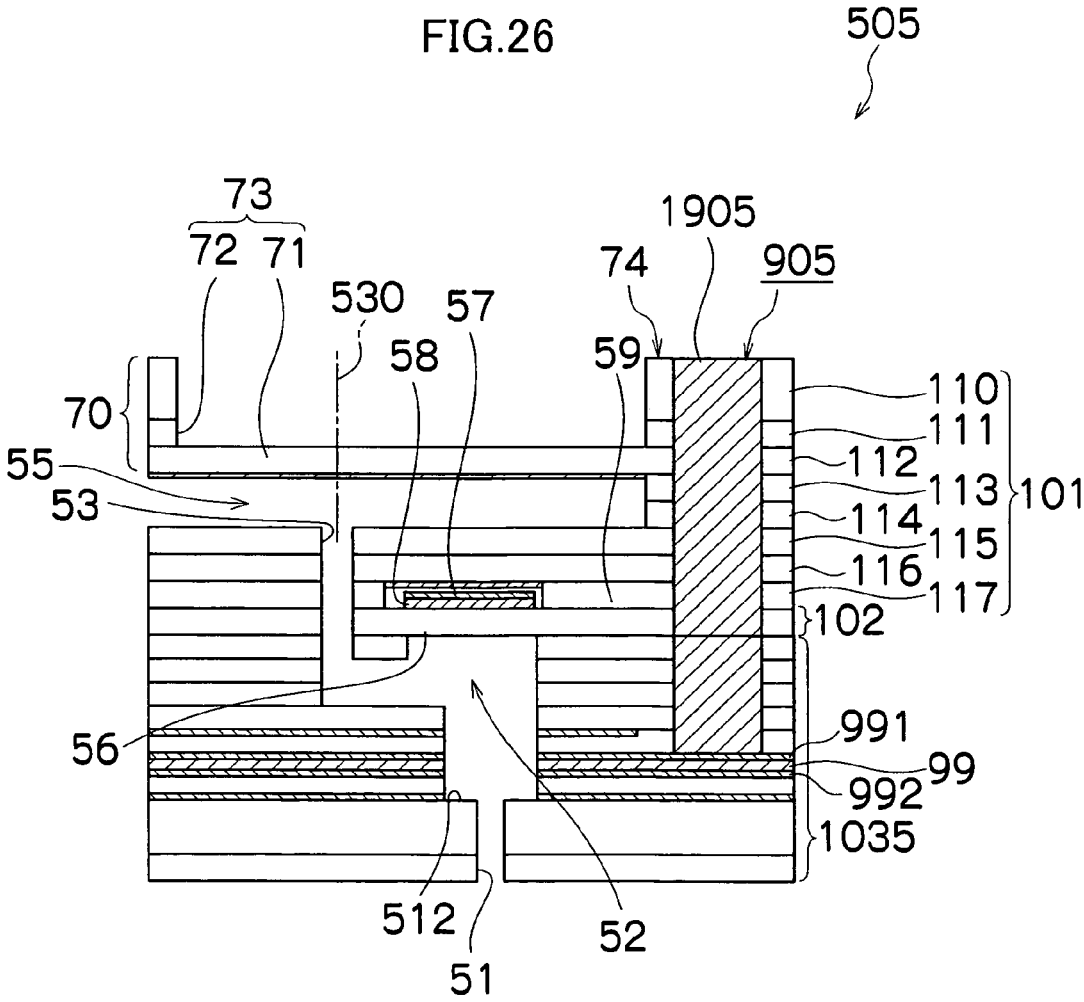
FIG. 26 is a sectional view showing the principal portions of a print head according to a fifth embodiment.

FIG. 26 is a sectional view showing a portion of a print head 505, which is a liquid ejection head according the fifth embodiment of the present invention.

In FIG. 26, to structural elements which are the same as ones of the first embodiment print head 50 shown in FIG. 10, the same reference numerals are appended, and the detailed explanation thereof will be curtailed.

With this print head 505 according to the fifth embodiment, the electrical wires 905 are not elements which supply drive signals to the piezoelectric elements 58, but are elements which transmit sensor signals from a lower portion structural member 1035 comprising a sensor layer 99 which detects pressure and opposing electrodes 991 and 992. For example, the sensor layer 99 may be made as a pressure sensor for detecting non-ejection of ink drops. The electrical wires 905 are erected within the common liquid chamber 55 and pass through that common liquid chamber 55, and their end portions 1905 are exposed at the ceiling plate 70 as external electrodes.

Figure 27:
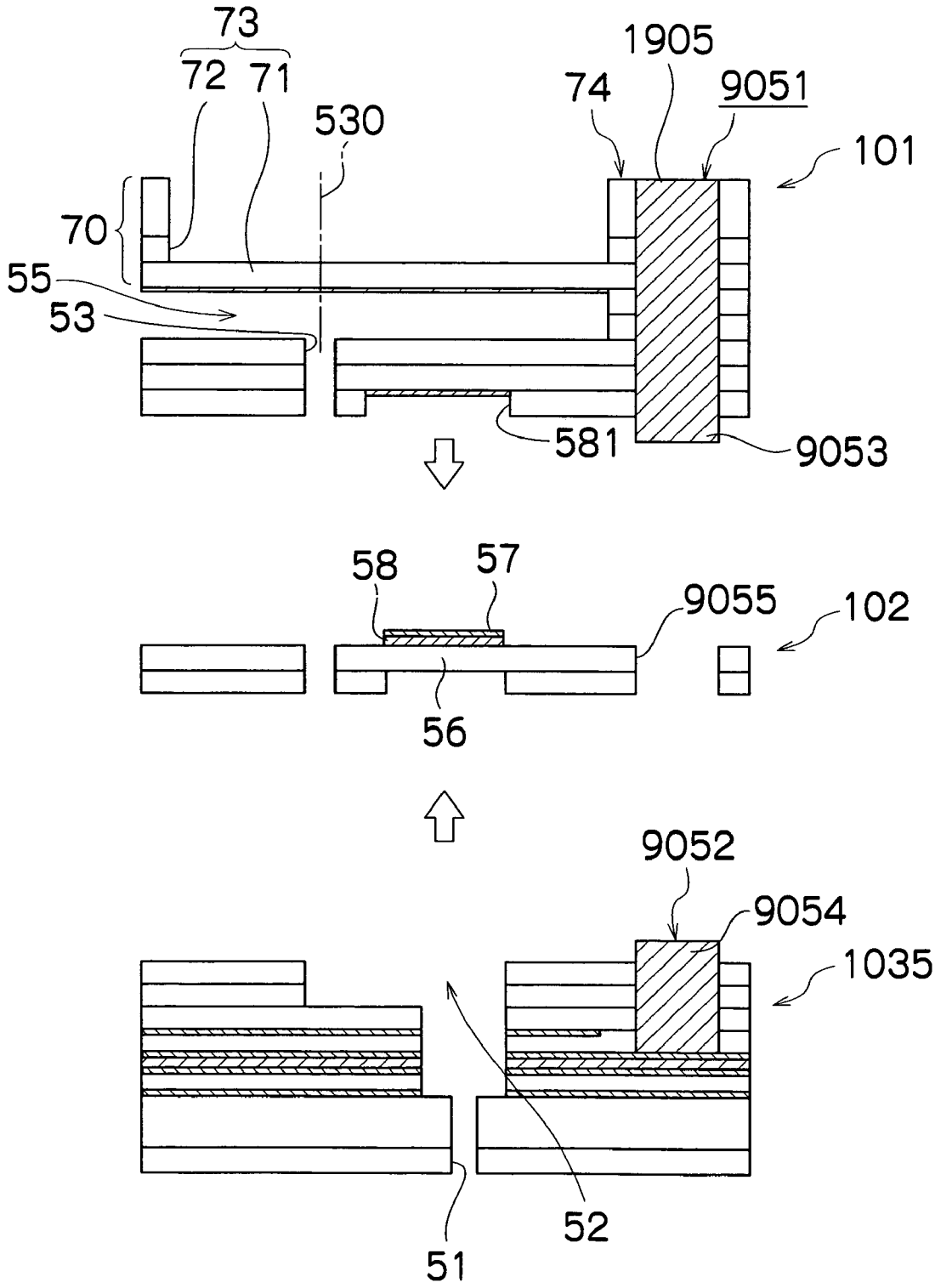
FIG. 27 is a dismantled sectional view for explanation of an upper portion structural member, a middle portion structural member, and a lower portion structural member of this print head according to the fifth embodiment.

A dismantled sectional view for explanation of the assembly of the upper portion structural member 101, the middle portion structural member 102, and the lower portion structural member 1035 of this print head 505 according to the fifth embodiment is shown in FIG. 27.

In FIG. 27, the lowest end 9053 of the upper portion 9051 belonging to the upper portion structural member 101 of the electrical wire 905, and the topmost end 9054 of the lower portion 9052 of the electrical wire 905 belonging to the lower portion structural member 1035 are made as projection portions which project from their corresponding resin layers, and moreover they are made so as, when the structural members are joined together, to engage into a through hole 9055 which is formed in the middle portion structural member 102 (a recess portion might also be formed).

Although, as shown in FIG. 6, in the above description of the first through the fifth embodiments, the pillar shaped electrical wires 90 which are erected within the common liquid chamber 55 and pass therethrough have been explained, by way of example, in terms of the case in which the peripheral portions 60 are formed so as to constitute insulating members which are coaxial with and surround these electrical wires 90, it goes without saying that, it would also be acceptable to provide them as forming a lattice shaped structure with differences in level, as shown in FIG. 7.

Furthermore, the thin layers 71 or the atmospheric communication apertures 80, 802, or 804 are not to be considered as being limited to the shapes shown in the drawings. For example, the shape of the thin layers 71 is not limited to a substantially square shape as shown in FIG. 9 and FIG. 22 and so on; they could also be round. Yet further, the atmospheric communication apertures 80 are not limited to being made in a double-staged shape as shown in FIG. 19 (i.e., having the small diameter portions 81 and the large diameter portions 82); they could also be made with three or more stages, or with only one stage.

Even further, the positions in which the thin layers 71 and the atmospheric communication apertures 80, 802, and 804 are arranged are not to be considered as being limited to being on the axes of the ink supply ports 53. For example, they might be located in the neighborhood of the ink supply ports 53.

Moreover, the electrical wires 90 and 905 are not to be considered as being limited to transmitting drive signals supplied to the piezoelectric elements 58 or sensor signals from pressure sensors. For example, it would also be acceptable to form electric wiring which transmits sensor signals from temperature sensors, or electric wiring which transmits signals to be supplied to heating elements (or cooling elements), substantially perpendicular to the surface on which the piezoelectric elements are disposed.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a nozzle surface on which a plurality of nozzles are arranged;

a diaphragm on which a plurality of piezoelectric elements are arranged;

a plurality of pressure chambers which are defined between the nozzle surface and the diaphragm, each of the plurality of pressure chambers applying pressure to liquid which is ejected from a corresponding one of the plurality of nozzles;

a common liquid chamber which is defined on a side of the diaphragm opposite to a side of the diaphragm on which the plurality of pressure chambers are defined, the common liquid chamber having an upper surface being a ceiling plate, the common liquid chamber communicating with each of the plurality of pressure chambers via a corresponding supply port, at least a portion of a surface of the common liquid chamber which contacts liquid being made as a thin layer;

a gas chamber which contacts the common liquid chamber via the thin layer, and communicates with atmosphere; and a plurality of electrical wires which are formed in a direction substantially perpendicular to a surface of the diaphragm on which the piezoelectric elements are arranged, at least a portion of each of the electrical wires passing through the common liquid chamber and at least a portion of each of the electrical wires passing through the ceiling plate of the common liquid chamber.

2. The liquid ejection head as defined in claim 1, wherein the thin layer is formed substantially perpendicular to an axis of the supply port.

3. A liquid ejection head, comprising:

a nozzle surface on which a plurality of nozzles are arranged;

a diaphragm on which a plurality of piezoelectric elements are arranged;

a plurality of pressure chambers which are defined between the nozzle surface and the diaphragm, each of the plurality of pressure chambers applying pressure to liquid which is ejected from a corresponding one of the plurality of nozzles;

a common liquid chamber which is defined on a side of the diaphragm opposite to a side of the diaphragm on which the plurality of pressure chambers are defined, the common liquid chamber communicating with each of the plurality of pressure chambers, the common liquid chamber having a wall in which an atmospheric communication aperture communicating with atmosphere is formed, a diameter of the atmospheric communication aperture being smaller than a diameter of the nozzle; and a plurality of electrical wires which are formed in a direction substantially perpendicular to a surface of the diaphragm on which the piezoelectric elements are arranged, at least a portion of each of the electrical wires passing through the common liquid chamber.

4. An image forming apparatus, comprising the liquid ejection head as defined in claim 1.

5. An image forming apparatus, comprising the liquid ejection head as defined in claim 3.

* * * * *